US007234883B2

(12) United States Patent
Yamamoto

(10) Patent No.: US 7,234,883 B2
(45) Date of Patent: Jun. 26, 2007

(54) TAPE PRINTER

(75) Inventor: Minoru Yamamoto, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 11/354,096

(22) Filed: Feb. 15, 2006

(65) Prior Publication Data

US 2006/0198681 A1 Sep. 7, 2006

(30) Foreign Application Priority Data

Mar. 7, 2005 (JP) ..... 2005-062243

(51) Int. Cl.
*B41J 2/315* (2006.01)

(52) U.S. Cl. ..... 400/120.16; 347/197; 347/220; 347/222

(58) Field of Classification Search ..... None
See application file for complete search history.

(56) References Cited

U.S. PATENT DOCUMENTS 2,851,945 A * 9/1958 Williamson ..... 101/93.44
3,018,725 A * 1/1962 Maul et al. ..... 101/269
RE32,281 E * 11/1986 Tsubo ..... 271/9.11
5,008,715 A * 4/1991 Imaizumi et al. ..... 399/392
5,219,234 A * 6/1993 Sakai ..... 400/120.16
5,839,840 A 11/1998 Kawano
5,913,623 A 6/1999 Yamaguchi et al.
6,749,352 B2 * 6/2004 Yamada et al. ..... 400/593
7,029,006 B2 * 4/2006 Izumi et al. ..... 271/145

FOREIGN PATENT DOCUMENTS

EP 0 832 753 A1 4/1998
JP A 10-100494 4/1998

* cited by examiner

*Primary Examiner*—Lamson Nguyen
*Assistant Examiner*—Justin Seo
(74) *Attorney, Agent, or Firm*—Oliff & Berridge, PLC

(57) ABSTRACT

It is intended to provide a tape printer which enables to forcibly separate a platen roller and a print head along with an opening operation of a cover element in case the platen roller and the print head have adhered to each other because of a long-period storage of the tape printer with the platen roller and the print head being in contact. Accordingly, a first gear formed in the platen roller and a rack member in which gear teeth engageable with the first gear are provided, so that a contact between the platen roller and a thermal head can be forcibly released by an engagement with a first gear and the gear teeth when the cover element is opened, and a roller holder is returned to a withdrawing position with a roller holder return spring for pressing the roller holder toward the withdrawing position.

12 Claims, 16 Drawing Sheets

TAPE PRINTER

TECHNICAL FIELD

The disclosure relates to a tape printer, especially to the tape printer which enables to forcibly separate a platen roller and a print head along with an opening operation of a cover element.

BACKGROUND

Conventionally, various kinds of tape printers which can print on a print tape of a long printing medium, displaying a text composed of characters inputted with input means such as a keyboard, have been suggested. In the tape printer, the print tape is generally supplied from a tape cassette in which the print tape and an ink ribbon are wound on each spool and housed in a predetermined-shape cassette.

In a tape cassette housing part of the tape printer, there are provided a print head for printing on the print tape and a platen roller for feeding the tape. In printing, the print tape is pressed against the print head by the platen roller to be printed the text thereon, and discharged as a printed tape. Herein, in order that the tape cassette is removed and re-installed for replacement, the print head and the platen roller need to be moved away from a pressing position of the print tape in order to release pressure exerted on the print tape by the print head and the platen roller. Accordingly, at least one of the print head and the platen roller is made movable, and a release member is provided to move the print head or the platen roller between the pressing position and a withdrawing position. Further, a cassette cover for covering the tape cassette installed in the tape cassette housing part is also provided. In printing, the cassette cover is closed to prevent entry of something extraneous from outside.

Japanese Patent Application laid-open No. H10(1998)-100494 discloses, as the release member described above, an engagement member which is provided in the cover element for moving a holder member (the platen roller) to the pressing position when the cover element is closed, and an elastic member for moving the holder member (the platen roller) to the withdrawing position when the cassette cover is opened.

However, in the tape printer of the above publication, there is a risk that, while the tape printer is stored for a long period with the platen roller and the print head being in contact, the platen roller and the print head have adhered to each other because of the absolute contact between a front face of the head and a roller rubber, and they can be no longer returned to the withdrawing position with a force of repulsion. If the repulsion of the elastic member is enhanced to solve the problem, the holder member and the like need to be strengthened, which increases costs.

SUMMARY

At least some example aspects of the disclosure have been made in view of the above circumstances and have an object to overcome the above problems and to provide a tape printer which enables to forcibly separate a platen roller and a print head along with an opening operation of a cover element in case the platen roller and the print head have adhered to each other because of a long-period storage of the tape printer with the platen roller and the print head being in contact.

To achieve the purpose of the disclosure, there is provided a tape printer comprising: a cassette holding part for removably holding a tape cassette housing a print tape therein; a print head for printing on the print tape; a platen roller placed to face the print head; a holder member for holding either one of the platen roller and the print head, and being movable between a first position in which the platen roller and the print head come into contact with each other, and a second position in which the platen roller and the print head are separated from each other; a cover element which is opened and closed over the holder member; an operation member constructed to be movable along with an opening and closing operation of the cover element, and to move the holder member to the first position during a closing operation of the cover element; an elastic member for forcing the holder member toward the second position during an opening operation of the cover element; and a forced turning device for releasing a contact between the platen roller and the print head by forcibly turning the platen roller along with a movement of the operation member during the opening operation of the cover element.

The above tape printer is provided with the forced turning device for releasing the contact between the platen roller and the print head by forcibly turning the platen roller along with a movement of the operation member during the opening operation of the cover element. Accordingly, the forced turning device can move the holder member to the second position with the operation member and the elastic member when the cover element is opened, so that it is possible to separate between the print head and the platen roller which have adhered to each other because of the long-period storage of the tape printer in which the holder member remains in the first position wherein the thermal head and the platen roller are in contact. This can avoid impossibility of setting the tape cassette in the cassette holding part and damage to the print tape and the ink ribbon.

According to another aspect of the disclosure, there is provided a tape printer comprising: a cassette holding part for removably holding a tape cassette housing a print tape therein; a print head for printing on the print tape; a platen roller placed to face the print head; a cover element which is opened and closed over the holder member; a holder member for holding either one of the platen roller and the print head, and being movable between a first position in which the platen roller and the print head come into contact with each other while the cover element is closed, and a second position in which the platen roller and the print head are separated from each other while the cover element is opened; and a drive motor for releasing a contact between the platen roller and the print head by forcibly turning the platen roller during an opening operation of the cover element.

The above tape printer is provided with the drive motor for releasing the contact between the platen roller and the print head by forcibly turning the platen roller with the drive motor during the opening operation of the cover element. Accordingly, the drive motor can move the holder member to the second position with the operation member and the elastic member when the cover element is opened, so that it is possible to separate between the print head and the platen roller which have adhered to each other because of the long-period storage of the tape printer in which the holder member remains in the first position wherein the thermal head and the platen roller are in contact. This can avoid impossibility of setting the tape cassette in the cassette holding part and damage to the print tape and the ink ribbon.

DETAILED DESCRIPTION

Figure 1:
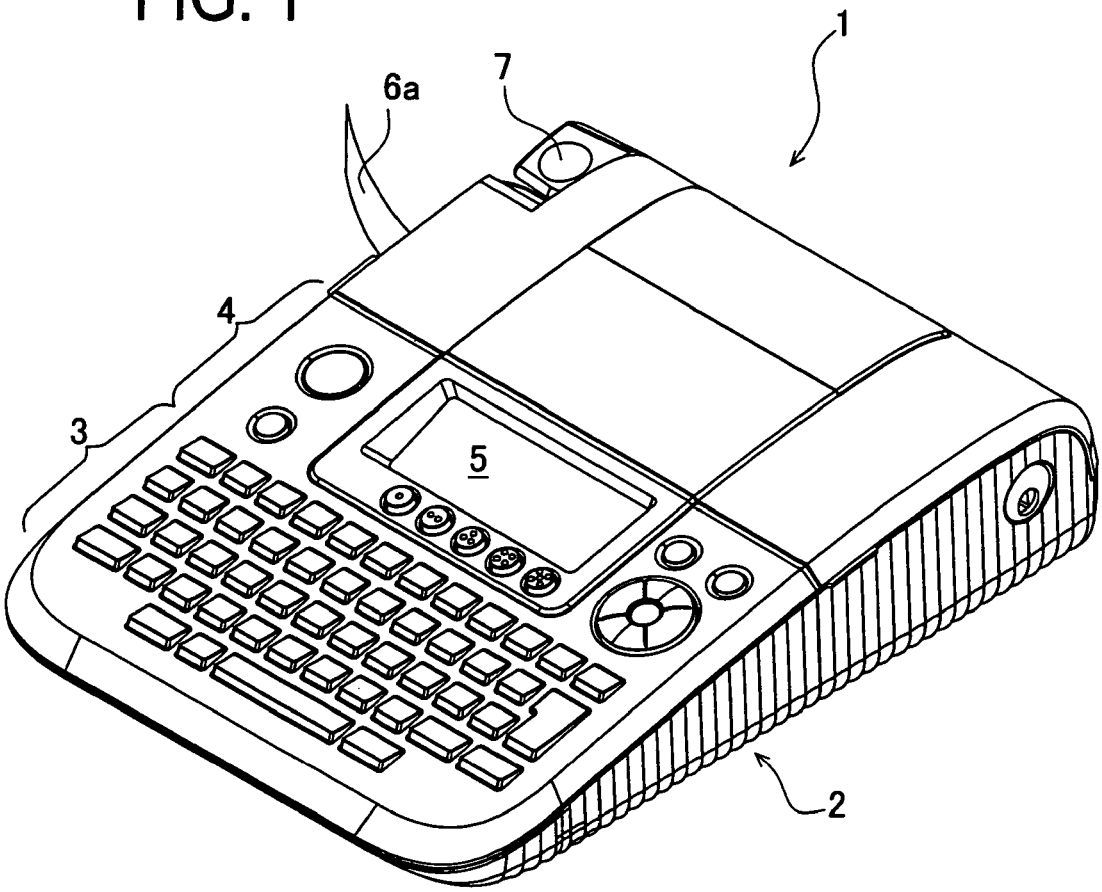
FIG. 1 is an external view of a tape printer in a first aspect of the disclosure.
Figure 2:
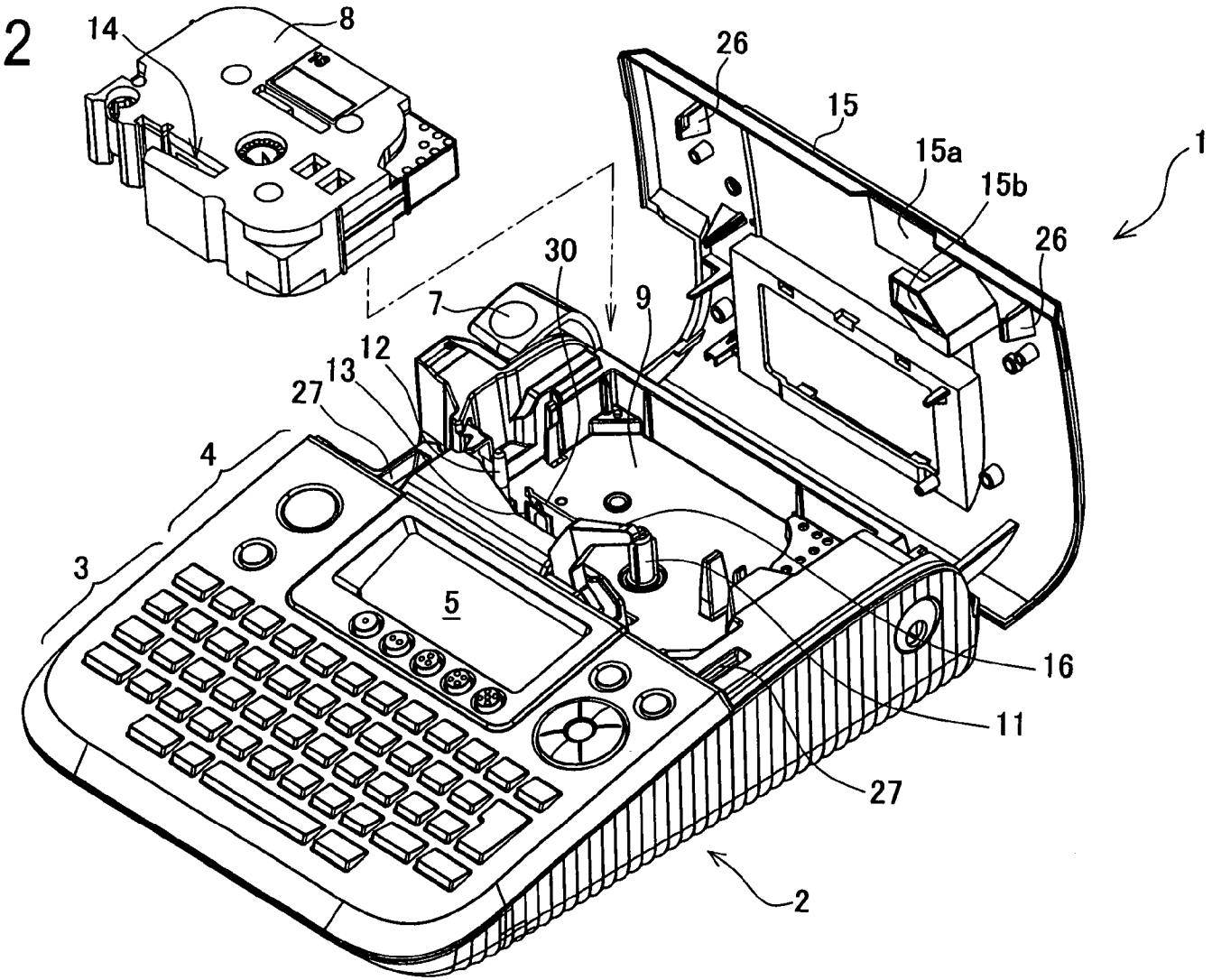
FIG. 2 is a perspective view of the tape printer with a cover element opened.
Figure 3:
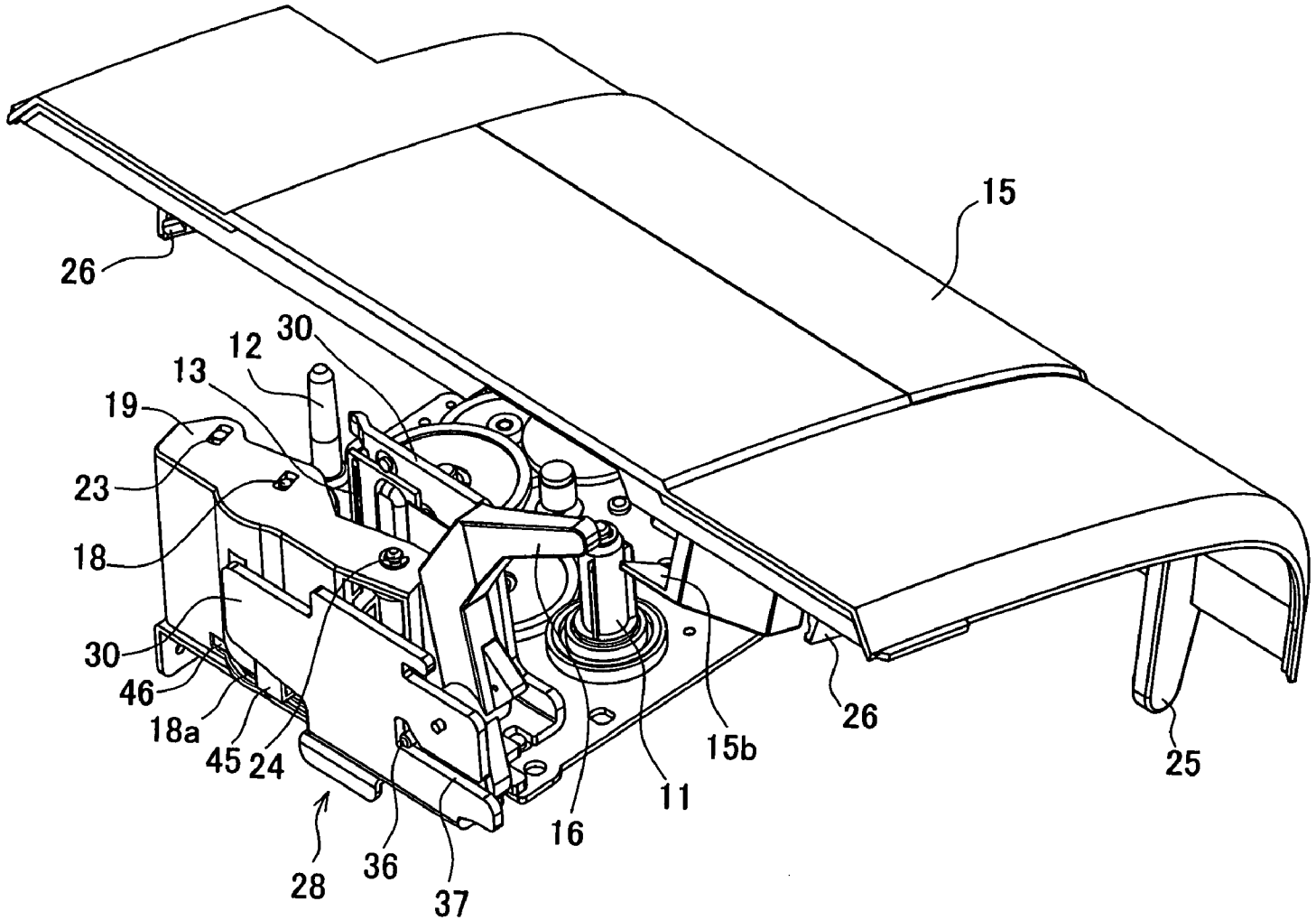
FIG. 3 is an enlarged perspective view of the cover element and a print mechanism.
Figure 4:
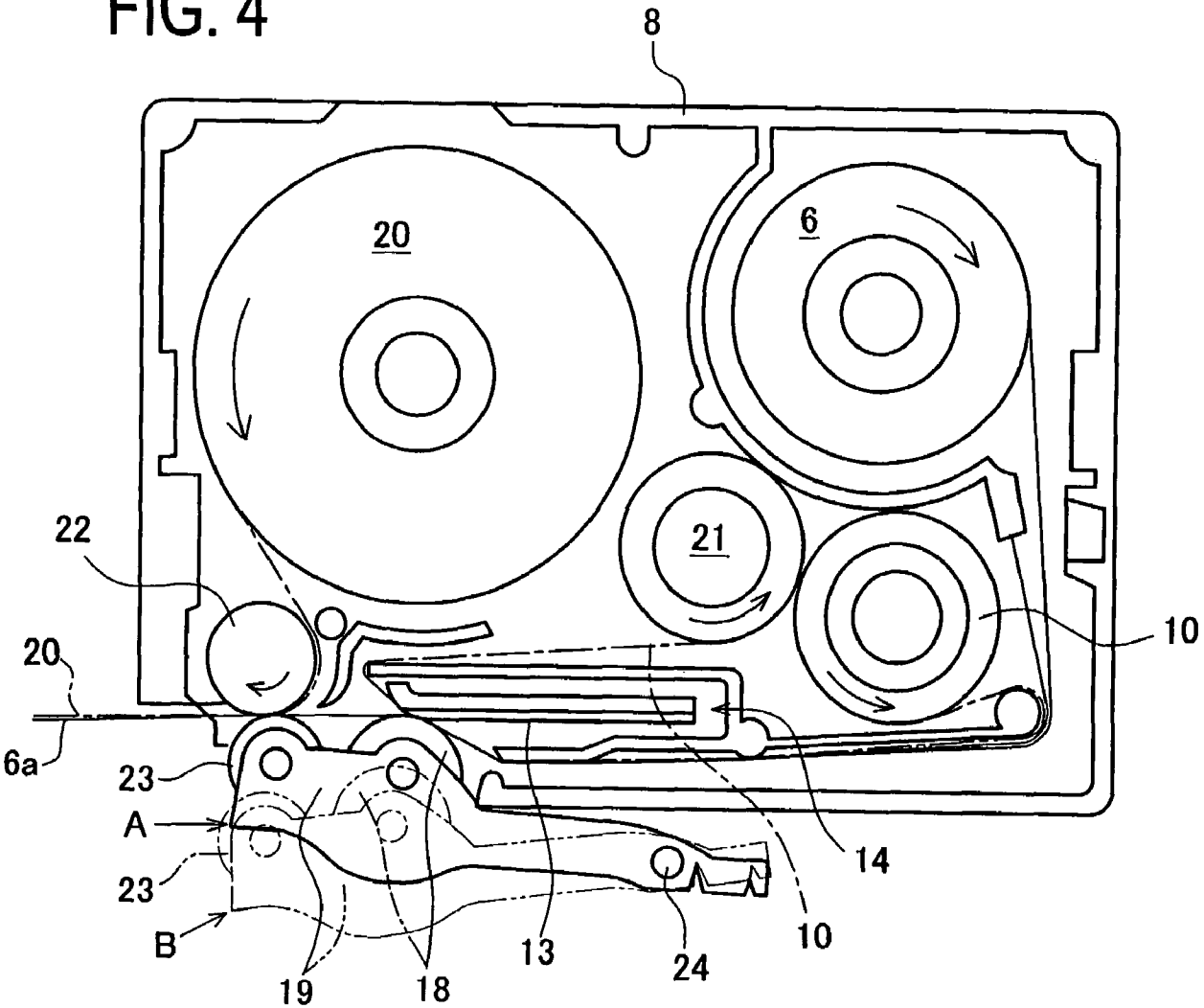
FIG. 4 is a schematic explanatory view of a relationship between a tape cassette and the print mechanism.

A detailed description of a first aspect of a tape printer embodying the disclosure will now be given referring to the accompanying drawings. Firstly, a schematic structure of the tape printer in the first aspect will be explained with reference to FIGS. 1 through 4. FIG. 1 is an external view of the tape printer in the first aspect of the disclosure. FIG. 2 is a perspective view of the tape printer with a cover element opened. FIG. 3 is an enlarged perspective view of the cover element and a print mechanism. FIG. 4 is a schematic explanatory view of a relationship between a tape cassette and the print mechanism.

As shown in FIG. 1, a tape printer 1 of the first aspect is provided with a keyboard 3, function keys 4, a liquid crystal display (hereinafter, a "LCD") 5, and a cutter lever 7. The keyboard 3, with which various kinds of characters are entered, is placed on a top face of a main body 2. Above the keyboard 3, there is provided the function keys 4 including a power switch and a print key for controlling the tape printer 1, and the LCD 5 for displaying the entered characters and symbols. The cutter lever 7 is provided at the upper left corner of the tape printer 1 for cutting a printed print tape 6*a* which is a print tape 6 on which printing is performed.

As shown in FIG. 2, a cassette holding part 9 is formed in a rear of the main body 2 to hold a tape cassette 8 (see FIG. 4) which houses the print tape 6 in a cassette case of a predetermined shape behind the LCD 5. In the cassette holding part 9, there are a ribbon take-up cam 11 for taking up a spent ink ribbon 10 in the tape cassette 8 and a tape feed roller cam 12 for feeding the printed print tape 6*a*. Additionally in the cassette holding part 9, a thermal head 13 for printing characters on the print tape 6 is attached to and arranged in a sub frame 30 for working also as a radiator so as to fit into an opening portion 14 of the tape cassette 8 when the tape cassette 8 is installed in the cassette holding part 9. As shown in FIG. 3, in a position facing the thermal head 13, a roller holder 19 holding a platen roller 18 and a pressing roller 23 is arranged together with a lever 16 so as to be turned about a holder shaft 24 with the lever 16 and an after-mentioned release rod 17.

As shown in FIGS. 2 and 3, the cassette holding part 9 is covered with a cover element 15 which is opened and closed. On the backside of the cover element 15, a lever pressing part 15*a* and an inferior lingulate hook 15*b* are positioned facing each other. The lever pressing part 15*a* is for pressing down the lever 16 when the cover element 15 is closed. The inferior lingulate hook 15*b* is for pulling up the lever 16 when the cover element 15 is opened. Further, engagement hooks 26, 26 are provided in both sides of the cover element 15. The engagement hooks 26, 26 are engaged with engagement members 27, 27 which are provided in the main body 2 of the tape printer 1 to keep the cover element 15 closed. Furthermore, supporting projection 25 which is extended from an end of the cover element 15 is provided as a supporting point for opening and closing the cover element 15.

Next, a structure of the tape cassette 8 will be explained with reference to FIG. 4, taking a laminated-tape cassette as an example. For explanation, FIG. 4 includes, in addition to the inner structure of the tape cassette 8, parts such as the thermal head 13 and the roller holder 19 which are portions of the print mechanism of the tape printer 1.

The tape cassette 8 houses the print tape 6, the ink ribbon 10, and a double-sided adhesive tape 20, which are rolled up in each of supply spools placed turnably. The print tape 6 of a predetermined width is made of a transparent film. The ink ribbon 10 is applied ink to be transferred to the print tape 6 on a front face thereof. The double-sided adhesive tape 20 of the same width as the print tape 6 adheres to the back face of the printed print tape 6*a*. Furthermore, there is placed a spent ink ribbon take-up spool 21 for taking up the spent ink ribbon 10. Inside the tape cassette 8, a tape feed roller 22 is built to discharge the printed print tape 6*a* to the outside of the tape cassette 8, and to stick the double-sided adhesive tape 20 on the back face of the printed print tape 6*a*.

When the tape cassette 8 is set into the cassette holding part 9 of the tape printer 1, the ribbon take-up cam 11 and the tape feed roller cam 12 in the cassette holding part 9 are fit into the spent ink ribbon take-up spool 21 and the tape feed roller 22 in the tape cassette 8 respectively. In printing, the spent ink ribbon take-up spool 21 and the tape feed roller 22 in the tape cassette 8 are rotated and driven. Accordingly, the print tape 6 and the ink ribbon 10 are unwound from each supply spool, overlapped each other, and fed to the thermal head 13 whereby performing a predetermined printing operation. After that, the spent ink ribbon 10 is separated from the printed print tape 6*a*, and wound on the spent ink ribbon take-up spool 21. The printed print tape 6*a* adheres to the supplied double-sided adhesive tape 20, and is discharged outward with the tape feed roller 22.

Next, a structure for pressing the print tape 6 against the thermal head 13 in printing will be explained. As mentioned above, the thermal head 13 provided in the cassette holding part 9 as in FIG. 2 is arranged to fit into the opening portion 14 of the tape cassette 8 when the tape cassette 8 is installed. The platen roller 18 is placed to face the thermal head 13, interposing the print tape 6 therebetween. A pressing roller 23 is placed facing the tape feed roller 22 of the tape cassette 8. The platen roller 18 and the pressing roller 23 are rotatably attached to the roller holder 19 which is turnably mounted on a holder shaft 24. As the roller holder 19 pivots, the platen roller 18 and the pressing roller 23 are set in either a pressing position A (indicated with a solid line) or a withdrawing position B (indicated with a two-dotted chain line). The pressing position A is the position wherein the platen roller 18 and the pressing roller 23 are pressed against the thermal head 13 and the tape feed roller 22 respectively. The withdrawing position B is the position wherein the rollers 18 and 23 are moved away from the thermal head 13 and the tape feed roller 22.

Figure 5:
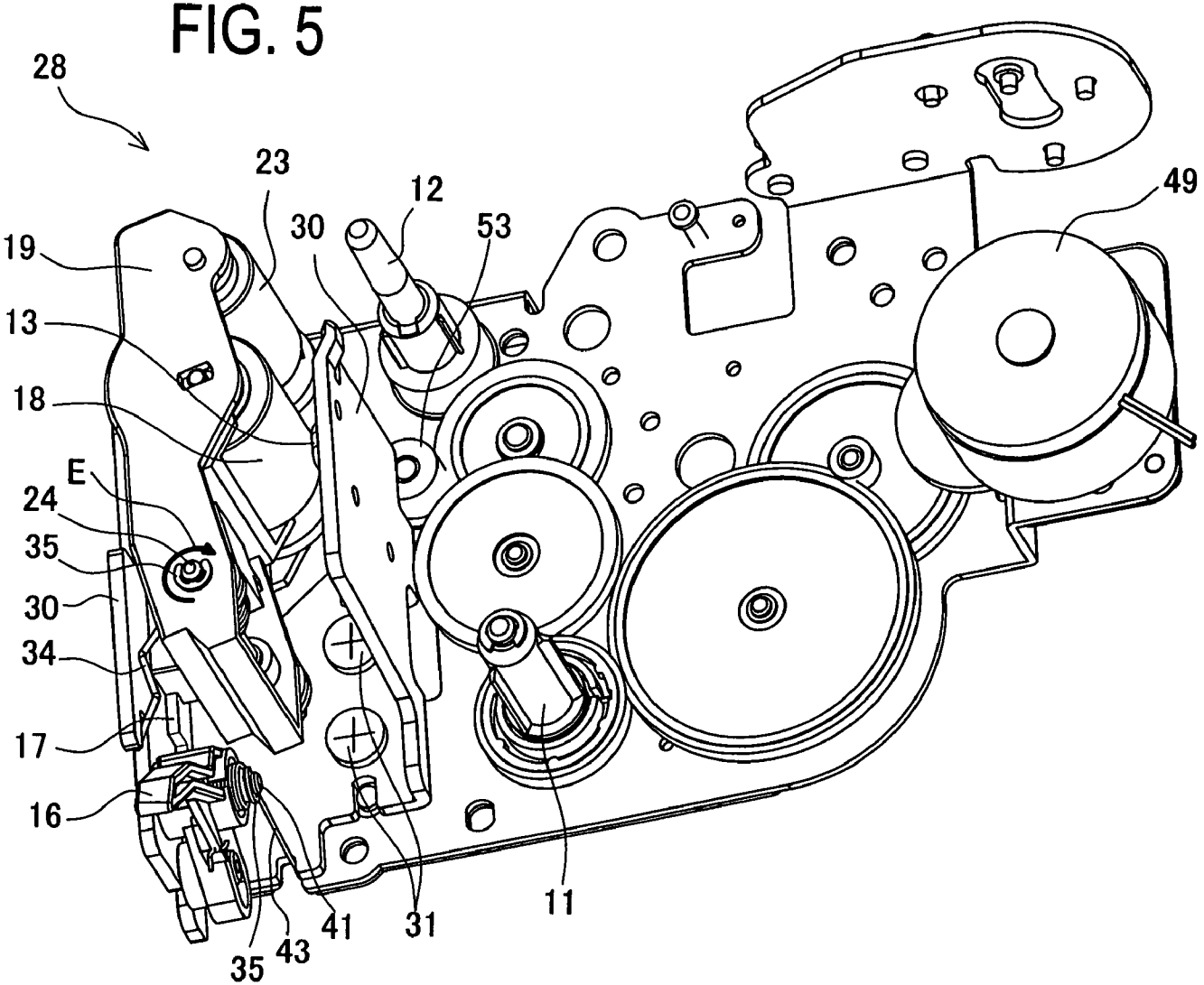
FIG. 5 is an enlarged perspective view of the print mechanism.
Figure 6:
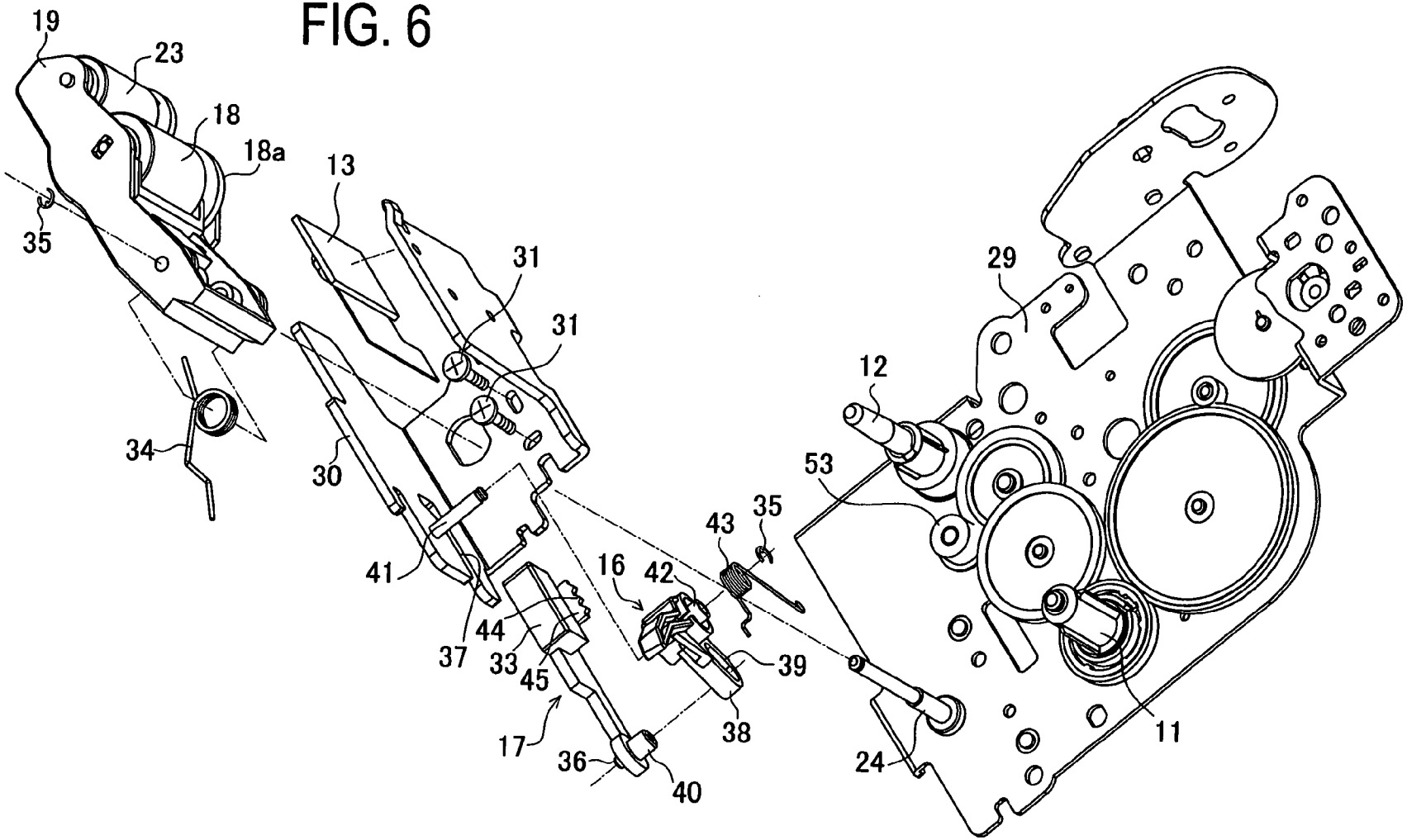
FIG. 6 is an exploded perspective view of the print mechanism.
Figures 7A, 7B:
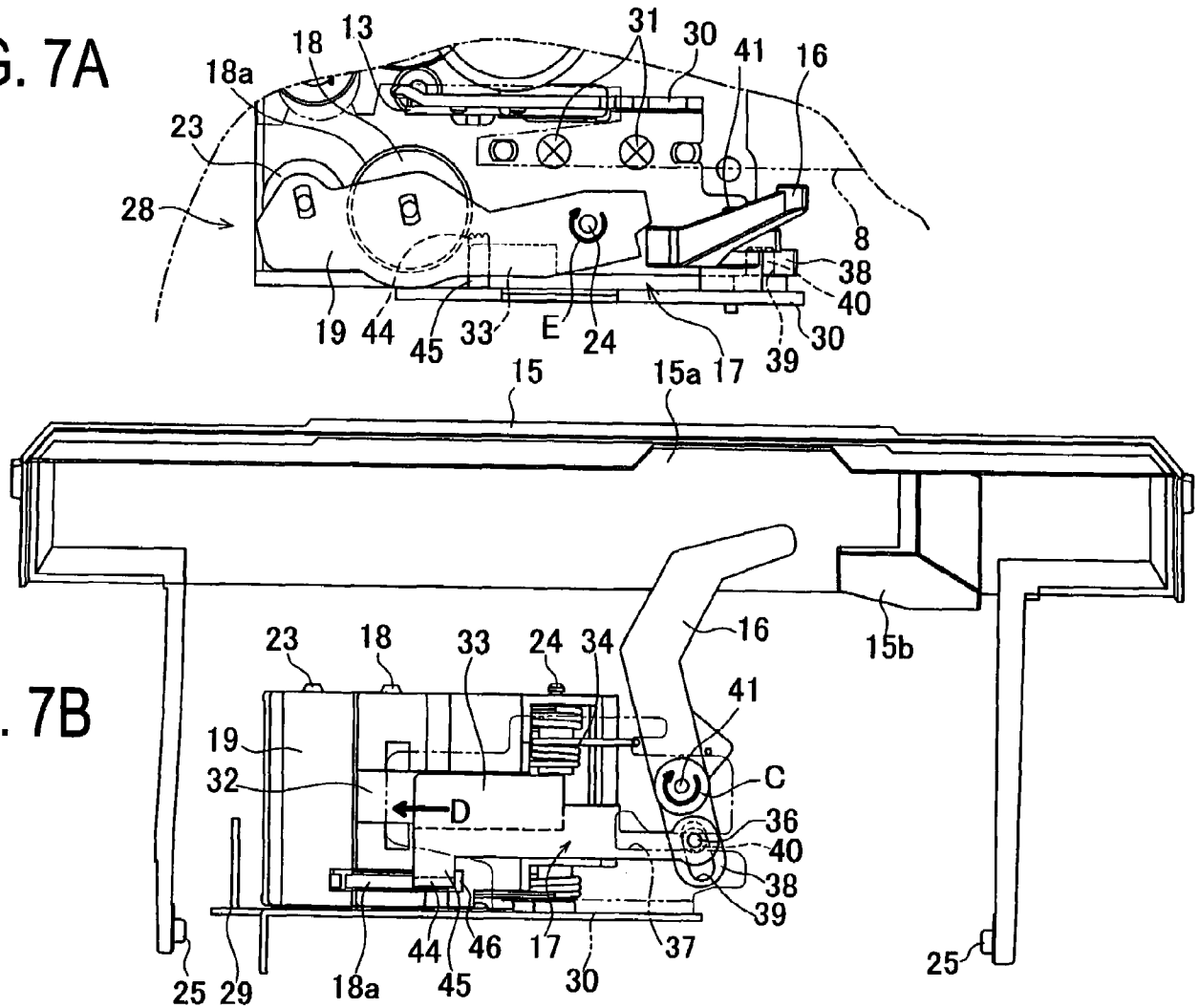
FIG. 7A is an explanatory top view of a relationship between the cover element, a lever, a release rod, and a roller holder when the cover element is opened.
FIG. 7B is an explanatory front view of the relationship between the cover element, the lever, the release rod, and the roller holder when the cover element is opened.
Figures 8A, 8B:
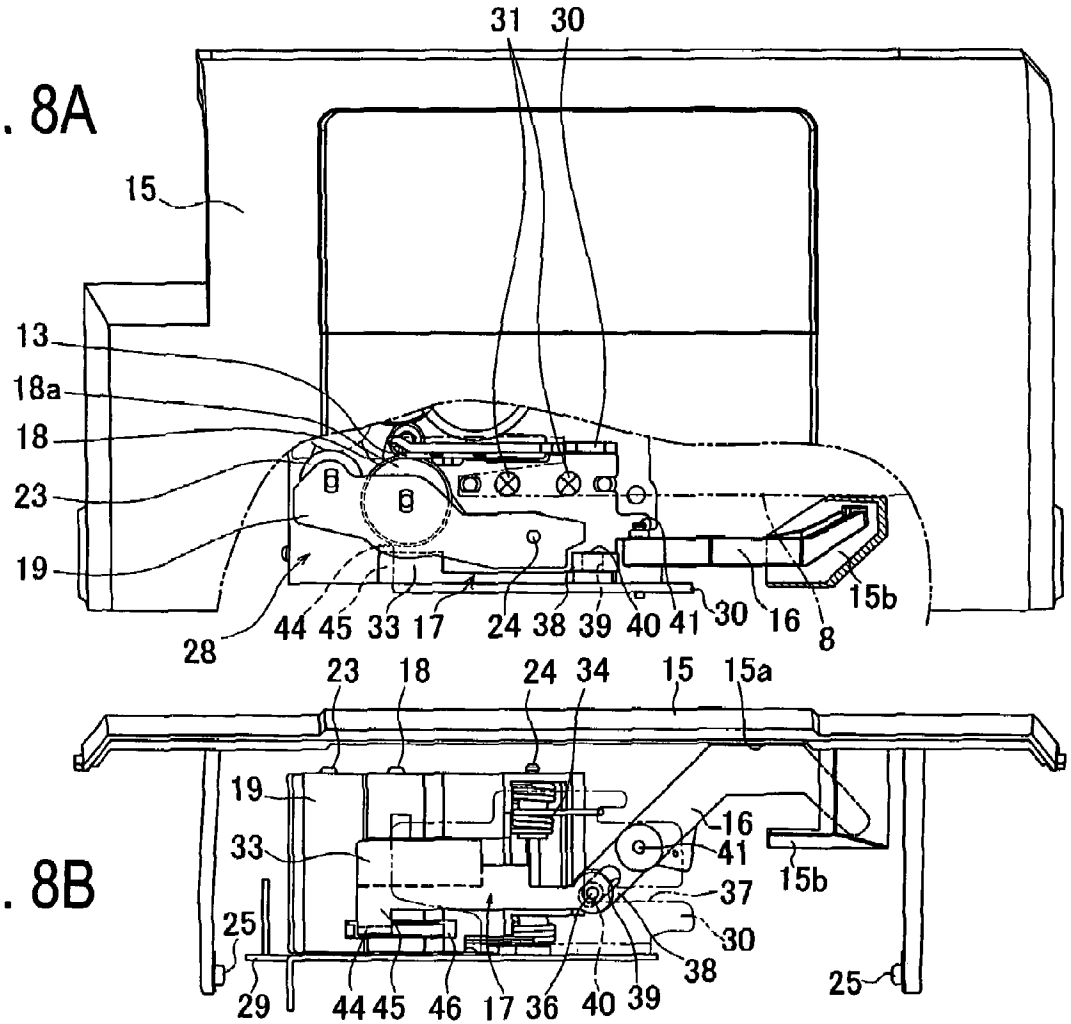
FIG. 8A is an explanatory top view of the relationship between the cover element, the lever, the release rod, and the roller holder when the cover element is closed.
FIG. 8B is an explanatory front view of the relationship between the cover element, the lever, the release rod, and the roller holder when the cover element is closed.

A structure for performing a pressure and a separation between the platen roller 18 and the thermal head 13, and the pressing roller 23 and the tape feed roller 22 by opening and closing the cover element 15 which covers the cassette holding part 9 will be explained referring to FIGS. 2, 3, and 5 through 8B. FIG. 5 is an enlarged perspective view of the print mechanism. FIG. 6 is an exploded perspective view of the print mechanism. FIG. 7A is an explanatory top view of a relationship between the cover element, the lever, the release rod, and the roller holder when the cover element is opened. FIG. 7B is an explanatory front view of the relationship between the cover element, the lever, the release rod, and the roller holder when the cover element is opened. FIG. 8A is an explanatory top view of the relationship between the cover element, the lever, the release rod, and the roller holder when the cover element is closed. FIG. 8B is an explanatory front view of the relationship between the cover element, the lever, the release rod, and the roller holder when the cover element is closed.

The cover element 15 capable of being opened and closed, as shown in FIGS. 2 and 3, covers the cassette holding part 9. The cover element 15 is attached to the main body 2 of the tape printer 1 with supporting projections 25, 25, and is opened and closed over the cassette holding part 9 by pivoting about the supporting projections 25, 25 shown in FIG. 3(only one of them is shown). The engagement hooks 26, 26 are provided at both sides of the cover element 15. The engagement hooks 26, 26 are engaged with engagement members 27, 27 which are provided in the main body 2 of the tape printer 1 to keep the cover element 15 closed. The engagement hooks 26, 26 are elastic, so that a predetermined operation can disengage them, and then open the cover element 15.

A print mechanism 28 as shown in FIG. 5 is placed in the cassette holding part 9 which is covered with the cover element 15. The print mechanism 28 is assembled as follows referring to FIG. 6. Firstly, the sub frame 30 is secured to a main frame 29 by screws 31, 31, being penetrated by the holder shaft 24 mounted on the main frame 29. The thermal head 13 is attached to the sub frame 30 which is functioning also as a radiator plate. Next, the roller holder 19 which has the platen roller 18 and the pressing roller 23 is turnably mounted on the holder shaft 24 with a roller holder return spring 34 and secured by an E-shaped stopper ring 35. At this time, a engagement part 33 provided at one end of the release rod 17 is attached to the roller holder 19 so as to be in contact with a engagement groove 32 (described later) provided in a backside of the roller holder 19, and gear teeth 44 of a rack member 45 provided at the one end of the release rod 17 and in parallel to the engagement part 33 are able to engage with a first gear 18*a* provided in the platen roller 18 through a through slot 46 (see FIGS. 3, 7A through 8B) perforated through the roller holder 19. Also at the same time, a sliding pin 36 provided at the other end of the release rod 17 is slidably fitted into a pin sliding slot 37 in the sub frame 30. After that, the lever 16 is turnably attached to a lever shaft 41 provided horizontally to the sub frame 30, while a sliding shaft 40 provided at the other end of the release rod 17 and the side opposite to the sliding pin 36 is engaged in a shaft sliding hole 39 provided at the other end of the lever 16. Further, a lever return spring 43 is fit into a spring attach shaft 42 of the lever 16, and kept in a predetermined position to be fastened by the E-shaped stopper ring 35 to the lever shaft 41. Finally, the print mechanism 28 has been completely assembled.

A process of using the tape printer 1 comprising the print mechanism 28 will now be explained with reference to FIGS. 2 and 7A through 8B. Firstly, as shown in FIG. 2, the tape cassette 8 is installed in the cassette holding part 9. To be closed, the cover element 15 is pressed down and the engagement hooks 26, 26 are engaged with the engagement members 27, 27. As shown in FIGS. 7A through 8B, during the closing operation, the print mechanism 28 functions as follows: As the cover element 15 is being closed, one end of the lever 16 is fit into a space between the lever pressing part 15*a* provided on the backside of the cover element 15 and the inferior lingulate hook 15*b* provided integrally with the cover element 15. The lever pressing part 15*a* presses the one end of the lever 16, and the lever 16 is turned down along an arrow C centering on the lever shaft 41. It is noted that the lever 16 needs to be always forced toward the opposite direction of the arrow C with the lever return spring 43 (see. FIG. 6) so that the one end of the lever 16 is fit into the space between the lever pressing part 15*a* and the inferior lingulate hook 15*b* when the cover element 15 is closed.

At an end 38 of the other end of the lever 16, there is provided the shaft sliding hole 39, to which the sliding shaft 40 of the other end of the release rod 17 is slidably attached. The shaft sliding hole 39 and the sliding shaft 40 converts a rotational movement of the lever 16 into a horizontal linear movement of the release rod 17. With the horizontal linear movement, the sliding pin 36 at the other end of the release rod 17 slides in the pin sliding slot 37 provided in the sub frame 30, and the engagement part 33 provided at the one end-of the release rod 17 slides in the abovementioned engagement groove 32 provided in the backside of the roller holder 19. Hence, the rotational movement of the lever 16 along the arrow C is converted into the horizontal linear movement of the release rod 17 in the direction of the arrow D.

When the aforesaid release rod 17 further continues the horizontal linear movement in the direction of the arrow D, the roller holder 19 is pressed by the engagement part 33 of the release rod 17, turned about the holder shaft 24 along the arrow E, and set in the pressing position A (see FIG. 4). Therefore, when the cover element 15 is closed, the roller holder 19 is always set in the pressing position A, and brought into a printable condition without any special operation for setting.

To remove the tape cassette 8 from the cassette holding part 9 after printing, the engagement hooks 26, 26 of the cover element 15 as shown in FIG. 2 are directly pulled up by fingers to open the cover element 15 without any special release operation. Specifically, the one end of the lever 16, which is fitted in the space between the lever pressing part 15*a* provided inside the cover element 15 and the inferior lingulate hook 15*b* provided integrally with the cover element 15 on the cover element 15, is pulled up by the inferior lingulate hook 15*b*, and the lever 16 is turned about the lever shaft 41 reversely along the arrow C.

Further, the rotational movement of the lever 16 to rotate reversely along the arrow C is converted into the horizontal linear movement of the release rod 17 to the direction opposite to the arrow D, with an engagement with the shaft sliding hole 39 of the lever 16 and the sliding shaft 40 of the release rod 17.

When the release rod 17 further continues the horizontal linear movement to the direction opposite to the arrow D, the roller holder 19 is released from a pressure from the engagement part 33 of the release rod 17. The roller holder 19 is moved and rotated about the holder shaft 24 reversely along the arrow E, and is set in the withdrawing position B (see FIG. 4) with the roller holder return spring 34. Therefore, the tape cassette 8 can be removed or installed as soon as the cover element 15 is opened. In other words, only one operation can work both for installing and removing the tape cassette 8.

Figure 9A:
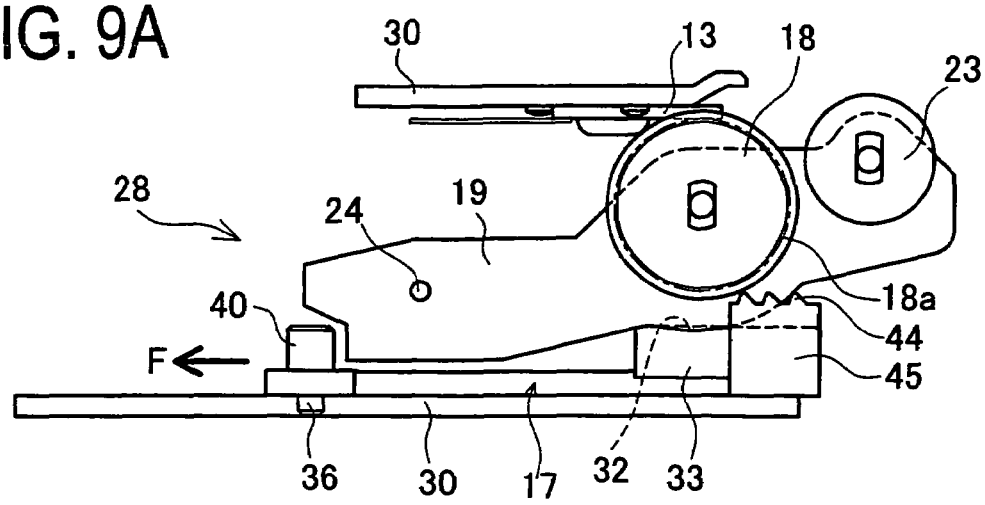
FIG. 9A is an explanatory view of a separation process between the thermal head and the platen roller which have adhered to each other when the cover element is completely closed.
Figure 9B:
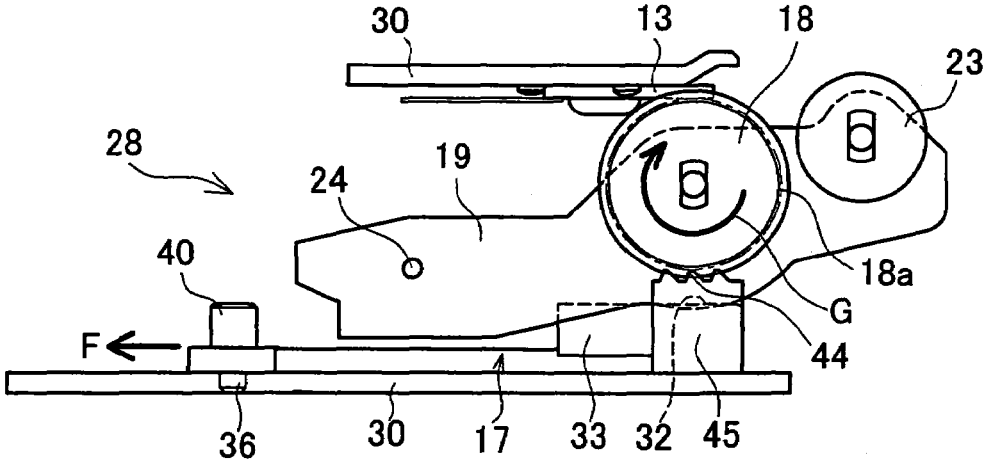
FIG. 9B is an explanatory view of the separation process between the thermal head and the platen roller which have adhered to each other when a first gear provided in the platen roller and a second gear provided in the release rod are in engagement.
Figure 9C:
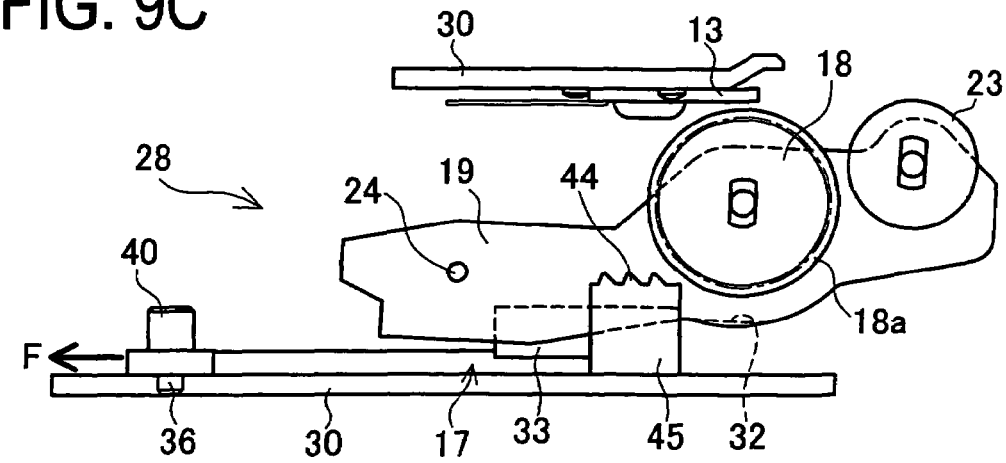
FIG. 9C is an explanatory view of the separation process between the thermal head and the platen roller which have adhered to each other when the first gear provided in the platen roller is disengaged from gear teeth of a rack member.
Figure 10A:
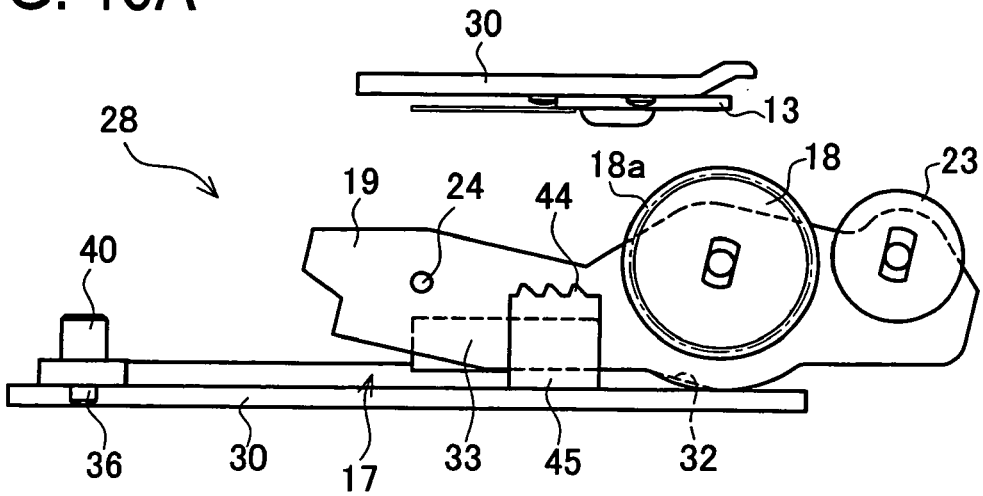
FIG. 10A is an explanatory view of the separation process between the thermal head and the platen roller which have adhered to each other when the cover element is completely opened.
Figure 10B:
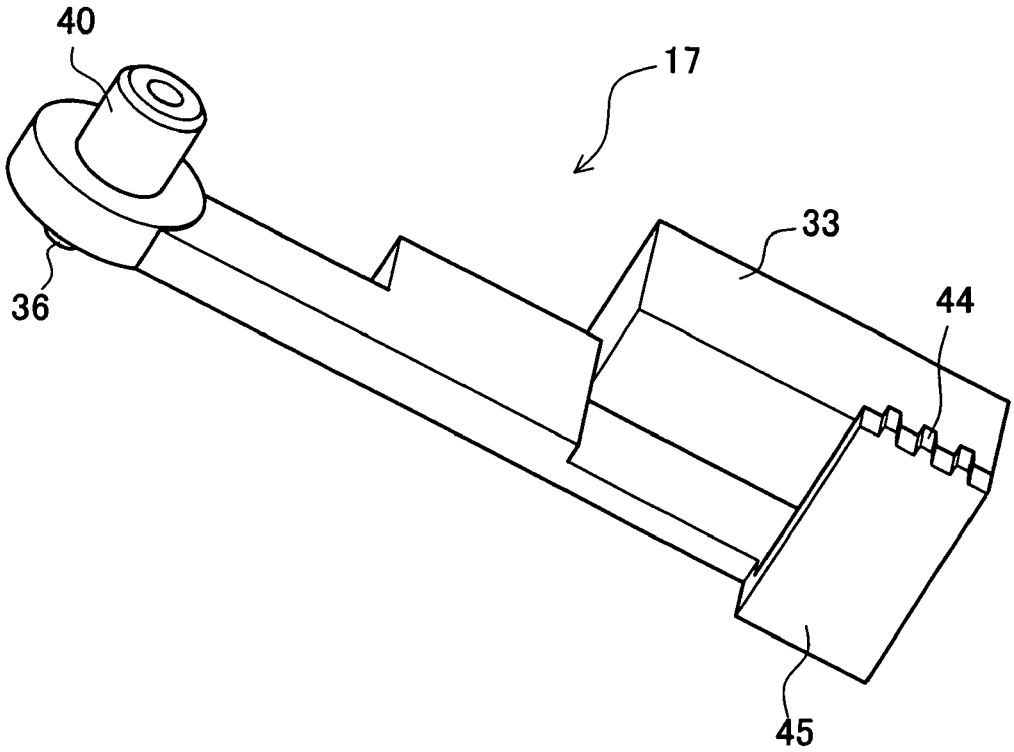
FIG. 10B is a perspective view of the release rod which is used in FIGS. 9A through 10A.

Next, a separation process between the thermal head 13 and the platen roller 18 which have adhered to each other after the tape printer 1 has been stored for a long period with the roller holder 19 set in the pressing position A with the tape cassette 8 uninstalled will be explained in detail with reference to FIGS. 9A through 10B. FIG. 9A is an explanatory view of the separation process between the thermal head and the platen roller which have adhered to each other when the cover element is completely closed. FIG. 9B is an explanatory view of the separation process between the thermal head and the platen roller which have adhered to each other when the first gear provided in the platen roller and a second gear provided in the release rod are in engagement. FIG. 9C is an explanatory view of the separation process between the thermal head and the platen roller which have adhered to each other when the first gear provided in the platen roller is disengaged from-the gear teeth of the rack member. FIG. 10A is an explanatory view of the separation process between the thermal head and the platen roller which have adhered to each other when the cover element is completely opened. FIG. 10B is a perspective view of the release rod which is used in FIGS. 9A through 10A.

Herein, a shape of the release rod 17 is explained as follows. As shown in FIG. 10B, the release rod 17 which the engagement part 33 is formed integrally with the one end of comes into contact with the engagement groove 32 provided in the roller holder 19, and slides therein. Further, the rack member 45 in which the gear teeth 44 are provided is formed integrally with and in parallel to the engagement part 33. The gear teeth 44 are provided in order to engage with the first gear 18*a*. At the other end of the release rod 17, the sliding shaft 40 is formed integrally, and slidably engaged with the shaft sliding hole 39 at the end 38 of the lever 16. The sliding pin. 36 is formed integrally with the sliding shaft 40 on the side opposite thereto to engage with the pin sliding slot 37 in the sub frame 30.

Next, the separation process between the thermal head 13 and the platen roller 18 which have adhered to each other will be explained including an operation of the release rod 17. In FIG. 9A, the cover element 15 is closed, and the engagement part 33 of the release rod 17 presses against the roller holder 19, sliding in the engagement groove 32 provided in the roller holder 19. The thermal head 13 and the platen roller 18 are brought into absolute contact with each other with the tape cassette 8 uninstalled, and set in the pressing position A (see FIG. 4).

In FIG. 9B, the release rod 17 starts to be moved to the direction of an arrow F as the cover element 15 is opened after a long-period storage in the state of FIG. 9A. The first gear 18*a* provided in the platen roller 18 and the gear teeth 44 formed in the rack member 45 of the release rod 17 are in engagement through the through slot 46 perforated through the roller holder 19 (see FIGS. 7B and 8B). The platen roller 18 is forcibly turned to the direction of an arrow G with this engagement. As a result, the thermal head 13 and the platen roller 18 which have adhered to each other are surely separated.

In FIG. 9C, as the cover element 15 is further opened, the release rod 17 continues to be moved to the direction of the arrow F. The first gear 18*a* provided in the platen roller 18 and the gear teeth 44 formed in the rack member 45 of the release rod 17 are disengaged, and at the same time, the engagement part 33 of the release rod 17 becomes released from the pressure against the roller holder 19. In this time, the platen roller 18 is separated from the thermal head 13, and then the roller holder 19 is reversely turned along the arrow E (see FIGS. 5, 7A and 7B) about the holder shaft 24 with the force (see FIGS. 7B and 8B) exerted by the roller holder return spring 34. Finally, the roller holder 19 starts to be returned to the withdrawing position B.(see FIG. 4).

In FIG. 10A, the cover element 15 is completely opened. The engagement part 33 and the rack member 45 forming the gear teeth 44 provided with the gear teeth 44 are set completely free. The roller holder 19 is turned reversely along the arrow E about the holder shaft 24, and set in the withdrawing position B (see FIG. 4).

As described in detail above, the tape printer 1 of the first aspect comprises the first gear 18*a* which is provided in the platen roller 18 and forcibly turns the platen roller 18 along with the movement of the release rod 17 to release the contact between the platen roller 18 and the thermal head 13 as the cover element 15 is opened, and the rack member 45 which is formed with the gear teeth 44 to engage with the first gear 18*a*. Accordingly, the first gear 18*a* and the gear teeth 44 which are in engagement forcibly release the contact between the platen roller 18 and the thermal head 13 when the cover element 15 is opened. The roller holder 19 is returned to the withdrawing position B with the force exerted by the roller holder return spring 34 for pressing the roller holder 19 toward the withdrawing position B. Accordingly, it becomes possible to separate the platen roller 18 and the thermal head 13 which have adhered to each other because of the long-period storage of the tape printer 1 in which the roller holder 19 remains in the pressing position A wherein the thermal head 13 and the platen roller 18 are in contact. Therefore, this can avoid impossibility of setting the tape cassette 8 in the cassette holding part 9 and damage to the print tape 6 and the ink ribbon 10. Furthermore, the rack member 45 in which the gear teeth 44 for engaging with the first gear 18*a* provided in the platen roller 18 can be formed integrally with the release rod 17, which can reduce the cost.

Figures 11A, 11B:
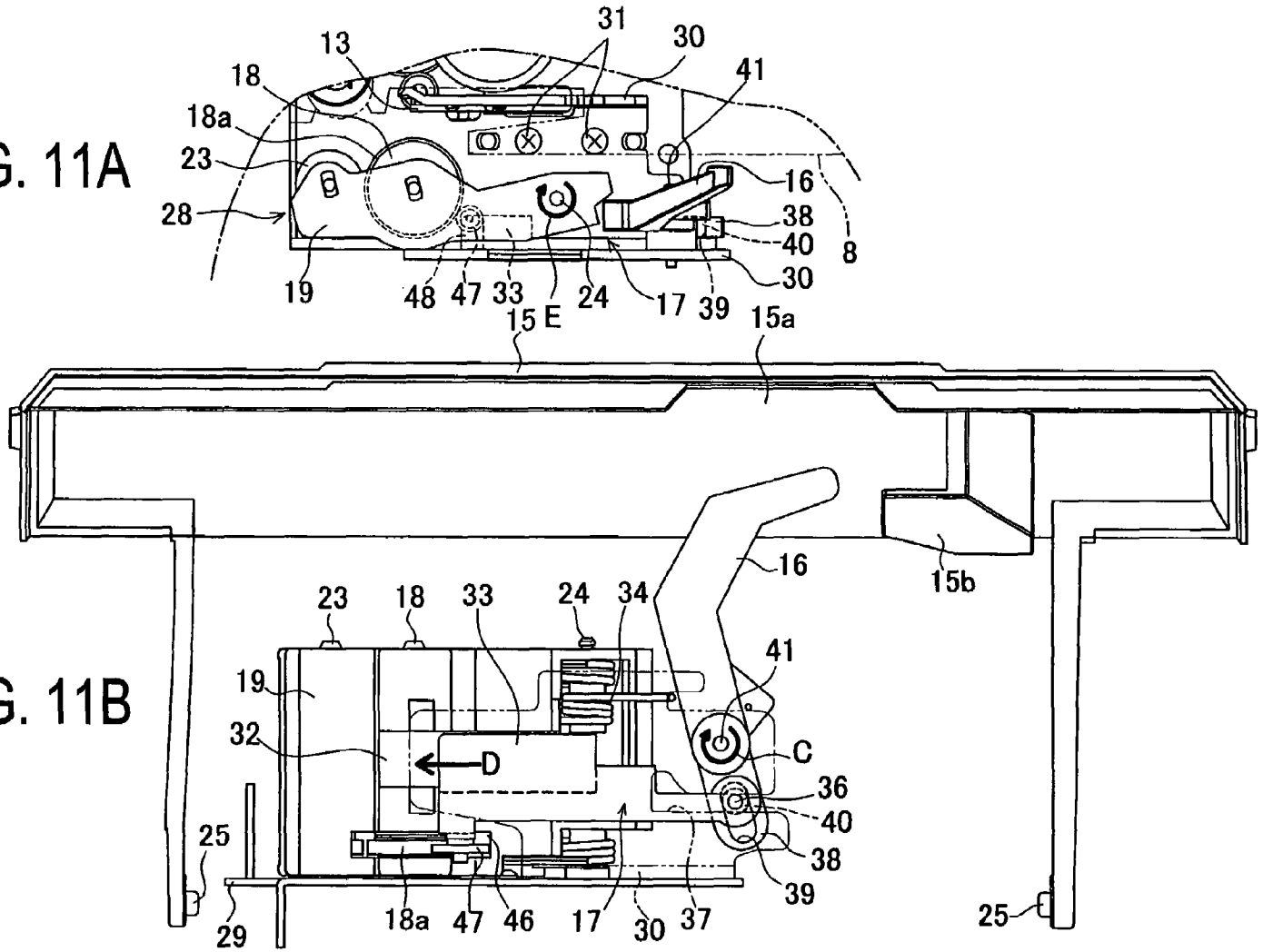
FIG. 11A is a top view of the relationship between the cover element, the lever, the release rod, and the roller holder when the cover element is opened.
FIG. 11B is a front view of the relationship between the cover element, the lever, the release rod, and the roller holder when the cover element is opened.
Figure 12A:
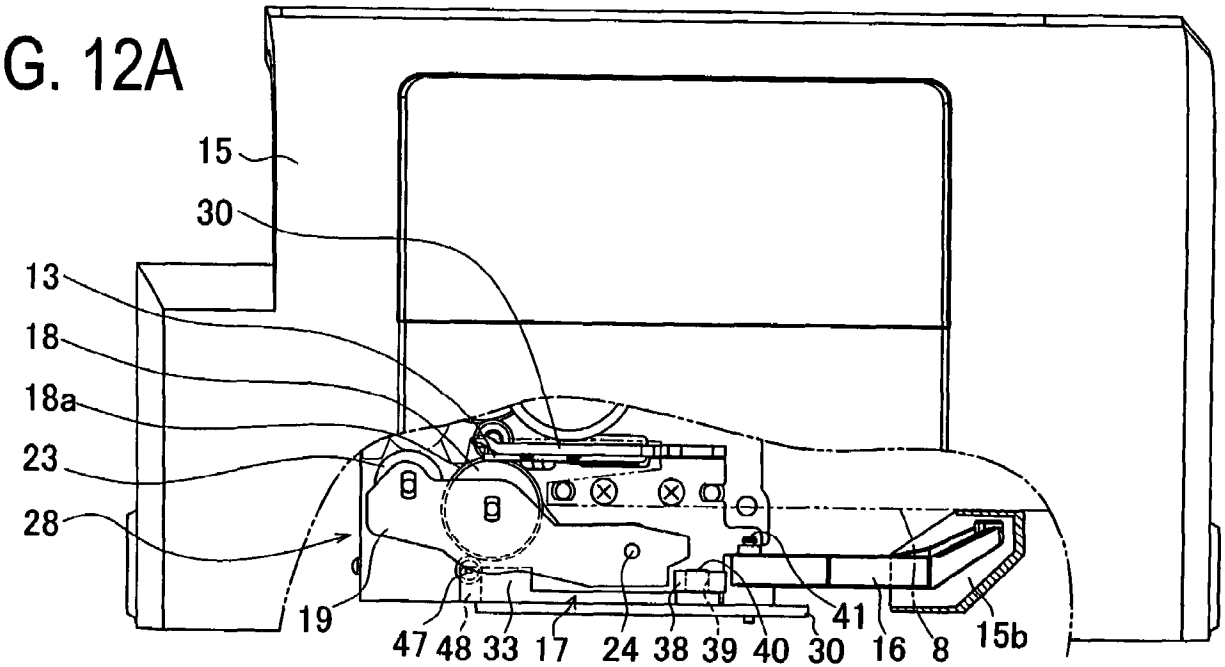
FIG. 12A is a top view of the relationship between the cover element, the lever, the release rod, and the roller holder when the cover element is closed.
Figure 12B:
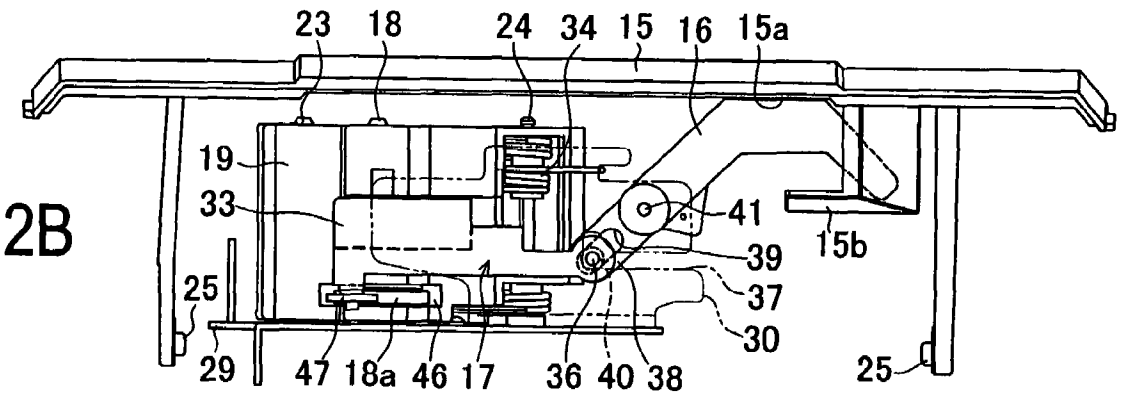
FIG. 12B is a front view of the relationship between the cover element, the lever, the release rod, and the roller holder when the cover element is closed.
Figure 13A:
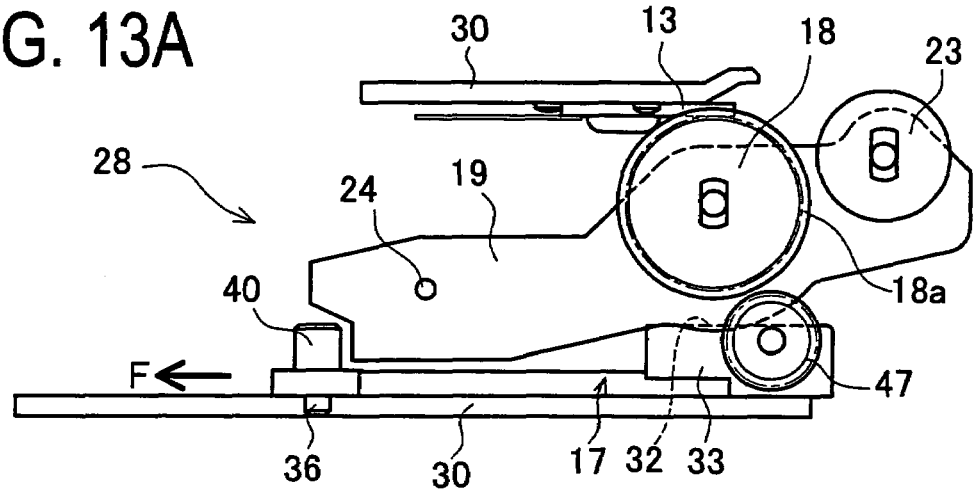
FIG. 13A is an explanatory view of the separation process between the thermal head and the platen roller which have adhered to each other when the cover element is completely closed.
Figure 13B:
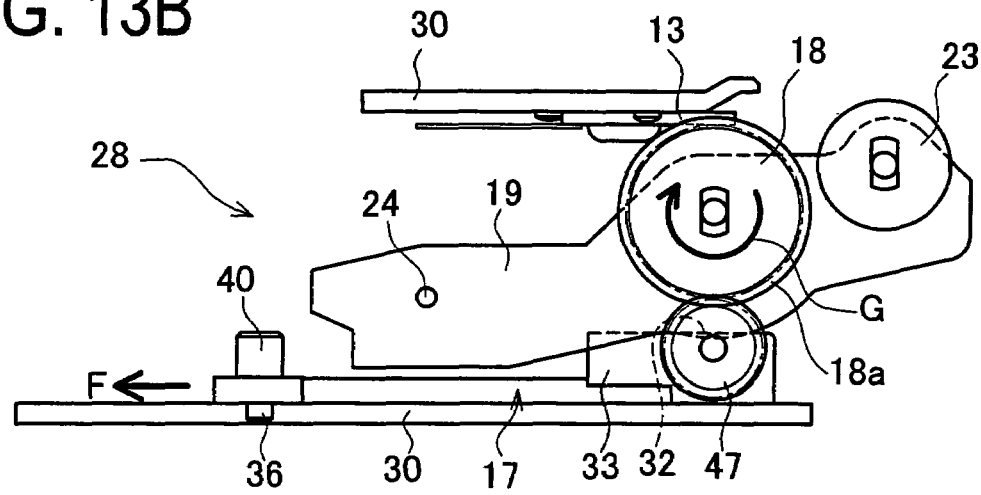
FIG. 13B is an explanatory view of the separation process between the thermal head and the platen roller which have adhered to each other when the first gear provided in the platen roller and the second gear provided in the release rod are in engagement.
Figure 13C:
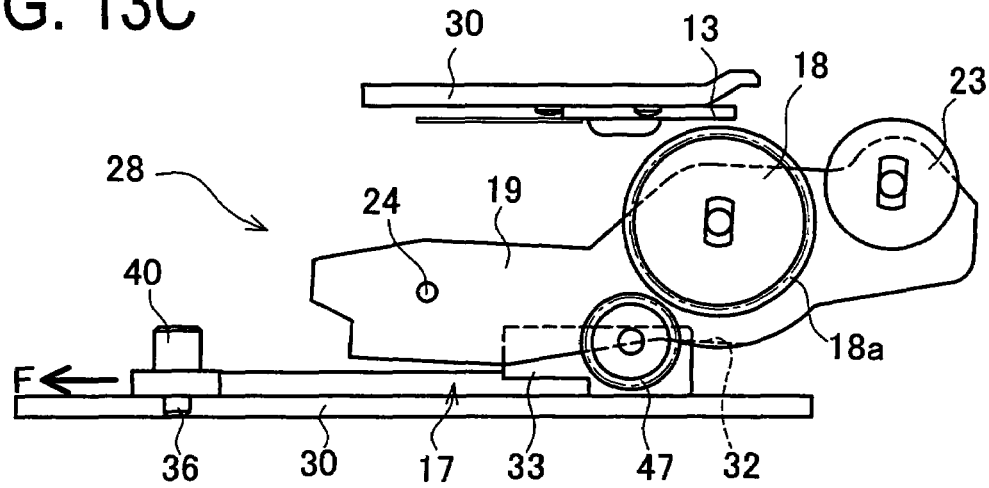
FIG. 13C is an explanatory view of the separation process between the thermal head and the platen roller which have adhered to each other when the first gear provided in the platen roller and the second gear provided in the release rod are disengaged, and the thermal head and the platen roller are separated from each other.
Figure 14A:
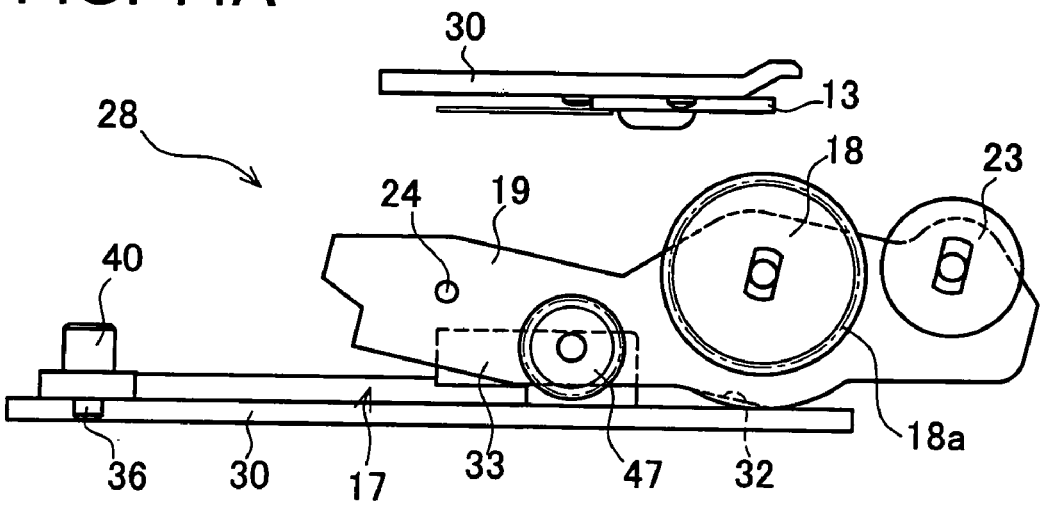
FIG. 14A is an explanatory view of the separation process between the thermal head and the platen roller which have adhered to each other when the cover element is completely opened.
Figure 14B:
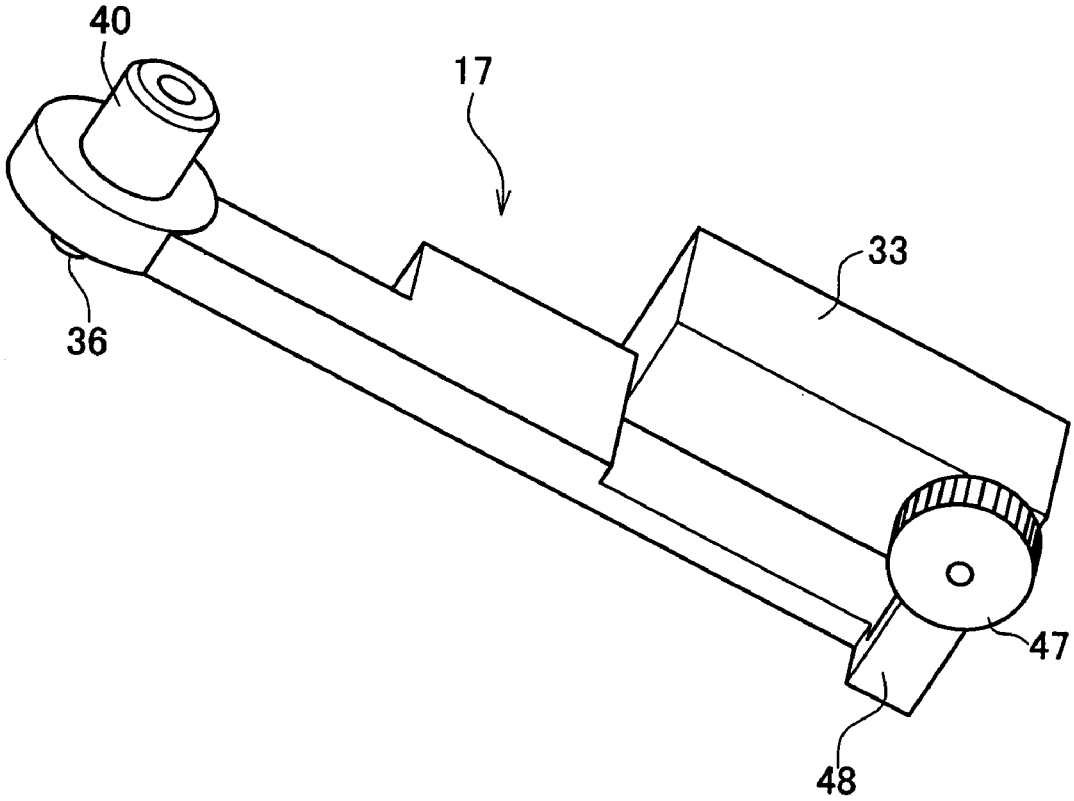
FIG. 14B is a perspective view of the release rod which is used in FIGS. 13A through 14A.

Next, a second aspect of the disclosure will now be explained. The structure of the tape printer of the second aspect is same as that of the tape printer 1 of the first aspect, but different in a forced turning process of the platen roller 18 with a forced turning device. In the first aspect, the gear teeth 44 provided in the rack member 45 formed integrally with the release rod 17 forcibly turn the platen roller 18 by the engagement with the first gear 18*a* provided in the platen roller 18. In the second aspect, on the contrary, a clutch gear 47 (a gear which is fixed in a shaft to one direction, and is turned at idle to the other direction) provided in the release rod 17 to engage with the first gear 18*a* forcibly turn the platen roller 18. The forced turning process of the second aspect is explained referring to FIGS. 11A through 14B. FIG. 11A is a top view of the relationship between the cover element, the lever, the release rod, and the roller holder when the cover element is opened. FIG. 11B is a front view of the relationship between the cover element, the lever, the release rod, and the roller holder when the cover element is opened. FIG. 12A is a top view of the relationship between the cover element, lever, the release rod, and the roller holder when the cover element is closed. FIG. 12B is a front view of the relationship between the cover element, the lever, the release rod, and the roller holder when the cover element is closed. FIG. 13A is an explanatory view of the separation process between the thermal head and the platen roller which have adhered to each other when the cover element is completely closed. FIG. 13B is an explanatory view of the separation process between the thermal head and the platen roller which have adhered to each other when the first gear provided in the platen roller and the second gear provided in the release rod are in engagement. FIG. 13C is an explanatory view of the separation process between the thermal head and the platen roller which have adhered to each other when the first gear provided in the platen roller and the second gear provided in the release rod are disengaged, and the thermal head and the platen roller are separated from each other. FIG. 14A is an explanatory view of the separation process between the thermal head and the platen roller which have adhered to each other when the cover element is completely opened. FIG. 14B is a perspective view of the release rod which is used in FIGS. 13A through 14A. Parts which are functionally the same as those in the first aspect are assigned the identical reference numerals to those in the first aspect.

Firstly, the structure of the print mechanism 28 is explained referring to FIGS. 12A and 12B. As shown in FIG. 12A, the thermal head 13 is provided at one end (on the upper side in FIG. 12A) of both ends of the sub frame 30 facing each other. The lever shaft 41 to which the lever 16 is tumably attached is provided on the other end (on the lower side in FIG. 12A) of the sub frame 30. The sliding shaft 40 which is provided at the other end of the release rod 17 (see FIG. 14B) having the engagement part 33 at the one end is slidably engaged into the shaft sliding hole 39 provided at the end 38 of the lever 16. The release rod 17 can slide to the direction of the arrow D (see FIG. 11B) or the opposite direction depending on the turning direction of the lever 16. Further, at the one end of the release rod 17, the clutch gear 47 which engages with the first gear 18*a* provided in the platen roller 18 through the through slot 46 perforated through the roller holder 19 is provided in a rib 48 which is provided in the release rod 17 and parallel to the engagement part 33. When the release rod 17 is moved to the direction of the arrow D (see FIG. 11B), the engagement part 33 of the release rod 17 presses against the engagement groove 32 (see FIG. 11B) provided in the roller holder 19. This brings the first gear 18*a* provided in the platen roller 18 and the clutch gear 47 provided in the rib 48 in the release rod 17 into mutual engagement, but the clutch gear 47 is adjusted to be turned at idle. Furthermore, when the release rod 17 is moved to the direction opposite to the arrow D, the first gear 18*a* provided in the platen roller 18 and the clutch gear 47 engage with each other, but the clutch gear 47 is adjusted to turn the platen roller 18, being fixed on the shaft not to be turned. The roller holder 19 to which the platen roller 18 and the pressing roller 23 are attached is turnably mounted on the holder shaft 24. Accordingly, the roller holder 19 is turned about the holder shaft 24 between the both ends of the sub frame 30, in accordance with the turning movement of the lever 16 of the engagement part 33 provided at the one end of the release rod 17, the movement of the clutch gear 47 provided in the rib 48 in the release rod 17 and in parallel to the engagement part 33, and the elastic force of the roller holder return spring 34.

A process of using the tape printer 1 comprising the print mechanism 28 will now be explained with reference to FIGS. 2 and 11A through 12B. Firstly, as shown in FIG. 2, the tape cassette 8 is installed in the cassette holding part 9.

To be closed, the cover element 15 is pressed down and the engagement hooks 26, 26 are engaged with the engagement members 27, 27. As shown in FIGS. 11A through 12B, during the closing operation, the print mechanism 28 functions as follows: As the cover element 15 is being closed, the one end of the lever 16 is fit into the space between the lever pressing part 15*a* provided on the backside of the cover element 15 and the inferior lingulate hook 15*b* provided integrally with the cover element 15. The lever pressing part 15*a* presses the one end of the lever 16, and the lever 16 is turned down along the arrow C centering on the lever shaft 41. It is noted that the lever 16 needs to be always forced toward the opposite direction of the arrow C with the lever return spring 43 (see. FIG. 6) so that the one end of the lever 16 is fit into the space between the lever pressing part 15*a* and the inferior lingulate hook 15*b* when the cover element 15 is closed.

At the end 38 of the other end of the lever 16, there is provided the shaft sliding hole 39, to which the sliding shaft 40 of the other end of the release rod 17 is slidably attached. The shaft sliding hole 39 and the sliding shaft 40 converts the rotational movement of the lever 16 into the horizontal linear movement of the release rod 17. With the horizontal linear movement, the sliding pin 36 at the other end of the release rod 17 slides in the pin sliding slot 37 provided in the sub frame 30, and the engagement part 33 provided at the one end of the release rod 17 slides in the abovementioned engagement groove 32 provided in the backside of the roller holder 19. Hence, the rotational movement of the lever 16 along the arrow C is converted into the horizontal linear movement of the release rod 17 in the direction of the arrow D.

When the aforesaid release rod 17 further continues the horizontal linear movement in the direction of the arrow D, the roller holder 19 is pressed by the engagement part 33 of the release rod 17, turned about the holder shaft 24 along the arrow E, and set in the pressing position A (see FIG. 4). Therefore, when the cover element 15 is closed, the roller holder 19 is always set in the pressing position A, and brought into the printable condition without any special operation for setting.

As mentioned above, in this time, the first gear 18*a* provided in the platen roller 18 and the clutch gear 47 provided in the rib 48 of the release rod 17 are in engagement through the through slot 46 perforated through the roller holder 19, but do not exert any influence on the platen roller 18 since the clutch gear 47 is turned at idle.

To remove the tape cassette 8 from the cassette holding part 9 after printing, the engagement hooks 26, 26 of the cover element 15 as shown in FIG. 2 are directly pulled up by fingers to open the cover element 15 without any special release operation. Specifically, the one end of the lever 16, which is fitted in the space between the lever pressing part 15*a* provided inside the cover element 15 and the inferior lingulate hook 15*b* provided integrally with the cover element 15 on the cover element 15, is pulled up by the inferior lingulate hook 15*b*, and the lever 16 is turned about the lever 41 reversely along the arrow C.

Further, the rotational movement of the lever 16 to rotate reversely along the arrow C is converted into the horizontal linear movement of the release rod 17 to the direction opposite to the arrow D, with the engagement with the shaft sliding hole 39 of the lever 16 and the sliding shaft 40 of the release rod 17.

When the release rod 17 further continues the horizontal linear movement to the direction opposite to the arrow D, the roller holder 19 is released from the pressure from the engagement part 33 of the release rod 17. The roller holder 19 is moved and rotated about the holder shaft 24 reversely along the arrow E, and is set in the withdrawing position B (see FIG. 4) with the roller holder return spring 34. Therefore, the tape cassette 8 can be removed or installed as soon as the cover element 15 is opened. In other words, only one operation can work both for installing and removing the tape cassette 8.

In this time, the first gear 18*a* provided in the platen roller 18 and the clutch gear 47 provided in the rib 48 of the release rod 17 are in engagement through the through slot 46 perforated through the roller holder 19, and forcibly turn the platen roller 18.

Next, the separation process between the thermal head 13 and the platen roller 18 which have adhered to each other after the tape printer 1 has been stored for a long period with the roller holder 19 set in the pressing position A and the tape cassette 8 uninstalled will be explained in detail with reference to FIGS. 13A through 14B.

In FIG. 13A, the cover element 15 is closed. The engagement part 33 of the release rod 17 (see FIG. 14B) presses against the roller holder 19, sliding in the engagement groove 32 provided in the roller holder 19. The thermal head 13 and the platen roller 18 are brought into absolute contact with each other with the tape cassette 8 uninstalled, and set in the pressing position A (see FIG. 4).

In FIG. 13B, the release rod 17 starts to be moved to the direction of the arrow F as the cover element 15 is opened after a long-period storage in the state of FIG. 13A. The first gear 18*a* provided in the platen roller 18 and the clutch gear 47 provided in the rib 48 (see FIG. 14B) of the release rod 17 are in engagement through the through slot 46 (see FIG. 11B and 12B) perforated through the roller holder 19. The platen roller 18 is forcibly turned to the direction of the arrow G with this engagement. As a result, the thermal head 13 and the platen roller 18 which have adhered to each other are surely separated.

In FIG. 13C, as the cover element 15 is further opened, the release rod 17 continues to be moved to the direction of the arrow F. The first gear 18*a* provided in the platen roller 18 and clutch gear 47 provided in the rib 48 in the release rod 17 are disengaged, and at the same time, the engagement part 33 of the release rod 17 becomes released from the pressure against the roller holder 19. In this time, the platen roller 18 is separated from the thermal head 13, and then the roller holder 19 is reversely turned along the arrow E (see FIGS. 5, 11A and 11B) about the holder shaft 24 with the force exerted by the roller holder return spring 34 (see FIGS. 11B and 12B). Finally, the roller holder 19 starts to be returned to the withdrawing position B (see FIG. 4).

In FIG. 14A, the cover element 15 is completely opened. The engagement part 33 and the clutch gear 47 are set completely free. The roller holder 19 is turned reversely along the arrow E about the holder shaft 24, and set in the withdrawing position B.

As described in detail above, the tape printer 1 of the second aspect comprises the first gear 18*a* which is provided in the platen roller 18 and forcibly turns the platen roller 18 along with the movement of the release rod 17 to release the contact between the platen roller 18 and the thermal head 13 as the cover element 15 is opened, and the clutch gear 47 which is in engagement with the first gear 18*a* and provided in the rib 48 of the release rod 17. Accordingly, when the cover element 15 is opened, the first gear 18*a* and the clutch gear 47 which are in engagement forcibly release the contact between the platen roller 18 and the thermal head 13. The roller holder 19 starts to be returned to the withdrawing position B with the force exerted by the roller holder return spring 34 for pressing the roller holder 19 toward the withdrawing position B. Accordingly, it becomes possible to separate the platen roller 18 and the thermal head 13 which have adhered to each other because of the long-period storage of the tape printer 1 in which the roller holder 19 remains in the pressing position A wherein the thermal head 13 and the platen roller 18 are in contact. Therefore, this can avoid impossibility of setting the tape cassette 8 in the cassette holding part 9 and damage to the print tape 6 and the ink ribbon 10. Furthermore, the first gear 18*a* provided in the platen roller 18 and the clutch gear 47 provided in the rib 48 of the release rod 17 are in engagement through the through slot 46 when the cover element 15 is closed. In this case, the clutch gear 47 is turned at idle, so that a heavy load on moving the release rod 17 can be avoided.

Figure 15A:
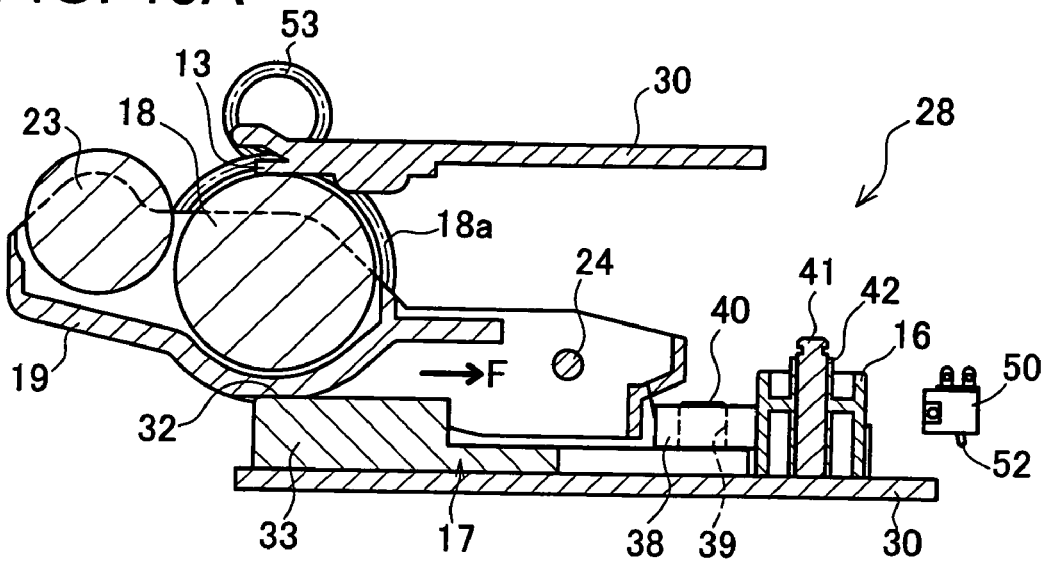
FIG. 15A is an explanatory view of the separation process between the thermal head and the platen roller which have adhered to each other when the cover element is completely closed.
Figure 15B:
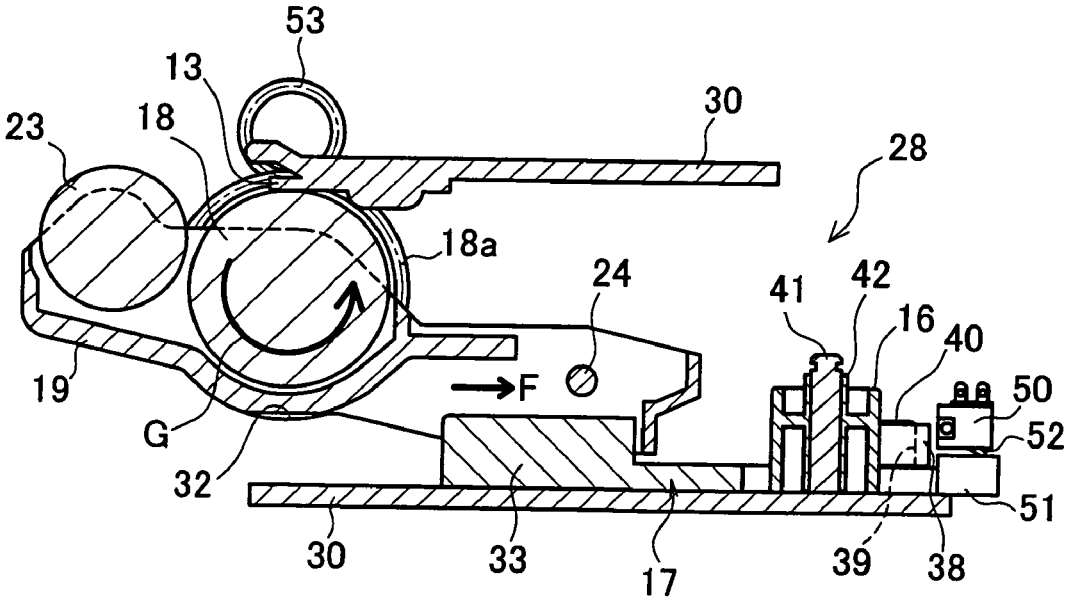
FIG. 15B is an explanatory view of the separation process between the thermal head and the platen roller which have adhered to each other when the thermal head and the platen roller adhere to each other.
Figure 16A:
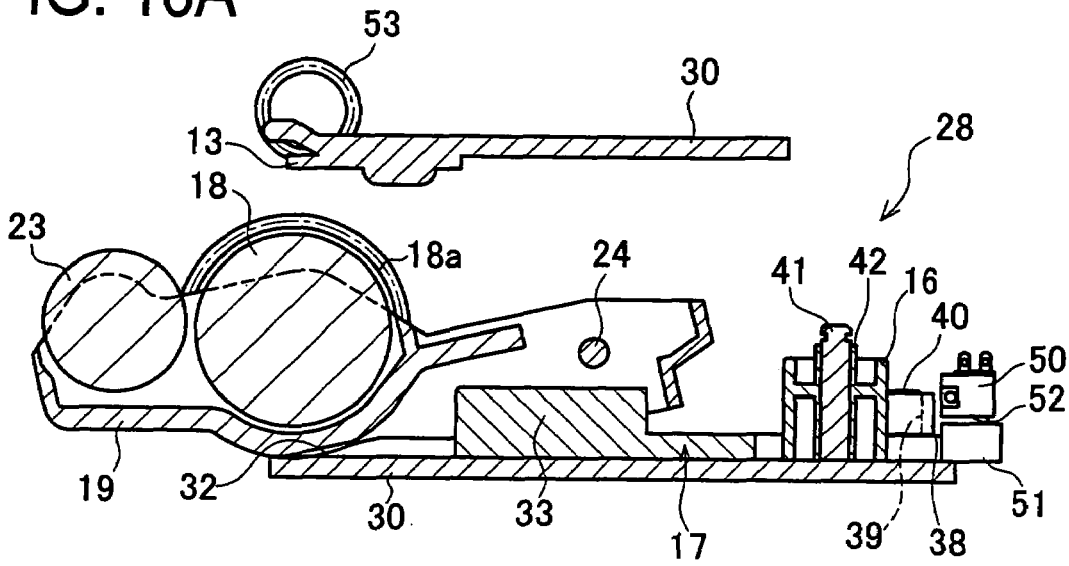
FIG. 16A is an explanatory view of the separation process between the thermal head and the platen roller which have adhered to each other when the cover element is completely opened.
Figure 16B:
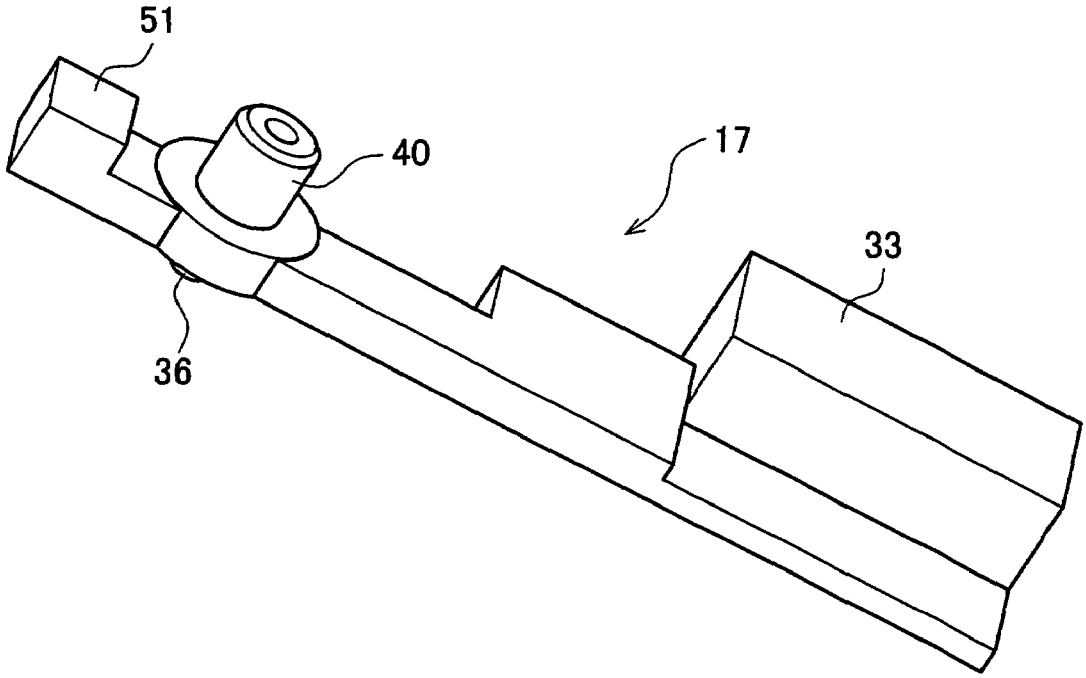
FIG. 16B is a perspective view of the release rod which is used in FIGS. 15A through 16A.

Next, a third aspect of the disclosure will now be explained. The structure of the tape printer of the third aspect is same as those of the tape printer 1 of the first and second aspects, but different in the forced turning process of the platen roller 18 with the forced turning device. In the first aspect, the gear teeth 44 provided in the rack member 45 formed integrally with the release rod 17 forcibly turn the platen roller 18 by the engagement with the first gear 18*a* provided in the platen roller 18. In the second aspect, the clutch gear 47 is provided in the release rod 17 to engage with the first gear 18*a* provided in the platen roller 18 to turn the platen roller 18. In the third aspect, in contrast to them, the platen roller 18 is forcibly turned by a drive motor 49 (see FIG. 5) which is originally provided in the tape printer 1 to print on and feed the print tape 6. The forced turning process of the third aspect is explained referring to FIGS. 15A through 16B. FIG. 15A is an explanatory view of the separation process between the thermal head and the platen roller which have adhered to each other when the cover element is completely closed. FIG. 15B is an explanatory view of the separation process between the thermal head and the platen roller which have adhered to each other when the thermal head and the platen roller adhere to each other. FIG. 16A is an explanatory view of the separation process between the thermal head and the platen roller which have adhered to each other when the cover element is completely opened. FIG. 16B is a perspective view of the release rod which is used in FIGS. 15A through 16A. Parts which are functionally the same as those in the first and second aspects are assigned the identical reference numerals to those in the first and second aspects.

Firstly, the structure of the print mechanism 28 is explained referring to FIG. 15A. As shown in FIG. 15A, the thermal head 13 is provided at the one end (on the upper side in FIG. 15A) of both ends of the sub frame 30 facing each other. The lever shaft 41 to which the lever 16 is turnably attached is provided at the other end (on the lower side in FIG. 15A) of the sub frame 30. The sliding shaft 40 which is provided at the other end of the release rod 17 (see FIG. 16B) having the engagement part 33 at the one end is slidably engaged into the shaft sliding hole 39 provided at the end 38 of the lever 16. The release rod 17 can slide to the direction of the arrow F or the opposite direction depending on the turning direction of the lever 16. Furthermore, a switch lever pressing part 51 (see FIG. 16B) is provided beside the sliding shaft 40 at the other end of the release rod 17. When the release rod 17 is moved toward the direction of the arrow F, a switch lever 52 of a detection switch 50 attached to the main body 2 (see FIGS. 1 and 2) is brought into contact with the switch lever pressing part 51, and then causes the activation of the detection switch 50. A control unit (not shown) which is originally provided in the tape printer 1 actuates the drive motor 49 by the activation of the detection switch 50, and turns the platen roller 18 by a drive gear 53 (see FIG. 5) and the first gear 18*a* provided in the platen roller 18. Between the both ends of the sub frame 30 facing each other, the roller holder 19 holding the platen roller 18 and the pressing roller 23 is turnably mounted on the holder shaft 24. Consequently, the roller holder 19 is configured to turn about the holder shaft 24 between the both ends of the sub frame 30 by the turning movement of the lever 16 of the engagement part 33 provided at the one end of the release rod 17, the activation of the detection switch 50, and the elastic force of the roller holder return spring 34 (see FIG. 6).

Next, the separation process using the drive motor 49 between the platen roller 18 and the thermal head 13 which have adhered to each other after the tape printer 1 has been stored for a long period with the roller holder 19 set in the pressing position A will be explained in detail with reference to FIGS. 15A through 16B.

In FIG. 15A, the cover element 15 is closed. The engagement part 33 of the release rod 17 (see FIG. 16B) presses against the roller holder 19, sliding in the engagement groove 32 provided in the roller holder 19. The thermal head 13 and the platen roller 18 are brought into absolute contact with each other with the tape cassette 8 uninstalled, and set in the pressing position A (see FIG. 4).

In FIG. 15B, the release rod 17 starts to be moved to the direction of the arrow F as the cover element 15 is opened after the long-period storage in the state of FIG. 15A. The release rod 17 reaches to its movable end, but the thermal head 13 and the platen roller 18 cannot be separated from each other even with the force exerted by the roller holder return spring 34, since the detection switch 50 is not activated to actuate the drive motor 49.

In FIG. 16A, the control unit (not shown) actuates the drive motor 49 by an actuation signal from the detection switch 50 and turns the drive gear 53. At this time, the first gear 18*a* which is in engagement with the drive gear 53 and provided in the platen roller 18 is forcibly turned along the arrow G, so that the contact between the platen roller 18 and the thermal head 13 is released, and they are separated from each other. After that, the roller holder 19 is moved and rotated about the holder shaft 24 reversely along the arrow E (see FIGS. 5, 7A, 7B, 11A and 11B), and is set in the withdrawing position B (see FIG. 4) with the force executed by the roller holder return spring 34.

As described in detail above, the tape printer 1 of the third aspect comprises the release rod 17 which is configured to be movable along with the opening and closing operation of the cover element 15, and starts to move the roller holder 19 toward the withdrawing position B when the cover element 15 is opened, the detection switch 50 for detecting the movement of the release rod 17 when the cover element 15 is opened, and the control unit for actuating and controlling the drive motor 49 when the detection switch 50 detects the movement of the release rod 17. The control unit can release the contact between the platen roller 18 and the thermal head 13 by actuating the drive motor 49. Accordingly, it becomes possible to separate the platen roller 18 and the thermal head 13 which have adhered to each other because of the long-period storage of the tape printer 1 in which the roller holder 19 remains in the pressing position A wherein the thermal, head 13 and the platen roller 18 are in contact. Therefore, this can avoid impossibility of setting the tape cassette 8 in the cassette holding part 9 and damage to the print tape 6 and the ink ribbon 10.

The disclosure may be embodied in other specific forms without departing from the essential characteristics thereof. For instance, in the first through third aspects, the thermal head 13 is fixed, and the roller holder 19 comprising the platen roller 18 is movable. The thermal head 13 may be movable.

While the aspect of the disclosure has been shown and described, it is to be understood that this disclosure is for the purpose of illustration and that various changes and modifications may be made without departing from the scope of the disclosure as set forth in the appended claims.

What is claimed is:

1. A tape printer comprising:

a cassette holding part for removably holding a tape cassette housing a print tape therein;

a print head for printing on the print tape;

a platen roller placed to face the print head;

a holder member for holding either one of the platen roller and the print head, and being movable between a first position in which the platen roller and the print head come into contact with each other, and a second position in which the platen roller and the print head are separated from each other;

a cover element which is opened and closed over the holder member;

an operation member constructed to be movable along with an opening and closing operation of the cover element, and to move the holder member to the first position during a closing operation of the cover element;

an elastic member for forcing the holder member toward the second position during an opening operation of the cover element; and a forced turning device for releasing a contact between the platen roller and the print head by forcibly turning the platen roller along with a movement of the operation member during the opening operation of the cover element.

2. The tape printer according to claim 1, wherein the forced turning device comprises a first gear provided in the platen roller and a rack member provided in the operation member and with a gear tooth being engageable with the first gear, and the gear tooth of the rack member turns the first gear by engaging with the first gear along with the movement of the operation member during the opening operation of the cover element.

3. The tape printer according to claim 2, wherein the first gear is provided at an end of the platen roller, and engages with the gear tooth of the rack member provided in the operation member through a through slot perforated through the holder member during the opening and closing operation of the cover element.

4. The tape printer according to claim 2, wherein the rack member provided with the gear tooth is formed integrally with the operation member.

5. The tape printer according to claim 1, wherein the forced turning device comprises the first gear provided in the platen roller and a second gear provided in the operation member and engageable with the first gear, and the second gear turns the first gear by engaging with the first gear along with the movement of the operation member during the opening and closing operation of the cover element.

6. The tape printer according to claim 5, wherein the first gear is provided at the end of the platen roller, and engages with the second gear provided in the operation member through the through slot perforated through the holder member during the opening and closing operation of the cover element.

7. The tape printer according to claim 5, wherein the second gear is a clutch gear.

8. A tape printer comprising:

a cassette holding part for removably holding a tape cassette housing a print tape therein;

a print head for printing on the print tape;

a platen roller placed to face the print head;

a cover element;

a holder member for holding either one of the platen roller and the print head, and being movable between a first position in which the platen roller and the print head come into contact with each other while the cover element is closed, and a second position in which the platen roller and the print head are separated from each other while the cover element is opened the cover element being opened and closed over the holder member; and a drive motor for releasing a contact between the platen roller and the print head by forcibly turning the platen roller during an opening operation of the cover element.

9. The tape printer according to claim 8, further comprising:

an operation member constructed to be movable along with an opening and closing operation of the cover element and for starting the holder member moving toward the second position during the opening operation of the cover element;

a detection device for detecting a movement of the operation member during the opening operation of the cover element; and a control device for driving and controlling the drive motor when the detection device detects the movement of the operation member, wherein the control device controls the drive motor to release the contact between the platen roller and the print head.

10. The tape printer according to claim 8, wherein the drive motor operates to feed the print tape by turning and driving the platen roller when the cover element is closed.

11. The tape printer according to claim 9, wherein the detection device for detecting the movement of the operation member during the opening operation of the cover element is a detection switch with a switch lever.

12. The tape printer according to claim 11, wherein a switch lever pressing part provided in the operation member presses the switch lever of the detection switch after a engagement part provided in the operation member is disengaged from an engagement groove provided in the holder member during the opening operation of the cover element.

* * * * *